US007417385B2

(12) United States Patent
Czernichowski et al.

(10) Patent No.: US 7,417,385 B2
(45) **Date of Patent: *Aug. 26, 2008**

(54) SYSTEMS AND METHOD FOR IGNITION AND REIGNITION OF UNSTABLE ELECTRICAL DISCHARGES

(75) Inventors: Albin Czernichowski, Orleans (FR); Bogdan Hnatiuc, Lasi (RO); Peter Pastva, Pontoise (FR); Albert Ranaivosoloarimanana, Nova Coladonia (FR)

(73) Assignee: Ceramatec, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/186,711

(22) Filed: Jul. 21, 2005

(65) Prior Publication Data

US 2005/0269978 A1 Dec. 8, 2005

Related U.S. Application Data

(63) Continuation of application No. 09/995,125, filed on Nov. 27, 2001, now Pat. No. 6,924,608.

(30) Foreign Application Priority Data

Nov. 27, 2000 (FR) ..... 00 15537

(51) Int. Cl.
*H01J 17/36* (2006.01)

(52) U.S. Cl. ..... 315/335; 219/383

(58) Field of Classification Search ..... 315/291, 315/111.21, 111.81, 111.71, 334, 335; 219/383
See application file for complete search history.

(56) References Cited

U.S. PATENT DOCUMENTS

| | | | |
|---|---|---|---|
| 3,863,107 | A | 1/1975 | Mogensen et al. |
| 4,144,444 | A | 3/1979 | Dementiev et al. |
| 4,198,590 | A | 4/1980 | Harris |
| 4,588,850 | A | 5/1986 | Mueller et al. |
| 4,606,799 | A | 8/1986 | Pirklbauer et al. |
| 4,661,763 | A | 4/1987 | Ari et al. |
| 4,861,446 | A | 8/1989 | Blom et al. |

(Continued)

FOREIGN PATENT DOCUMENTS

CA 1059065 7/1979

(Continued)

OTHER PUBLICATIONS

International Search Report re PCT/US01/44307, dated May 17, 2002.

(Continued)

*Primary Examiner*—Douglas W. Owens
*Assistant Examiner*—Ephrem Alemu

(57) ABSTRACT

Systems and methods for ignition and reignition of unstable electrical discharges wherein a secondary electrode positioned is between a set of primary electrodes and a high voltage is applied between the secondary electrode and successive ones of the primary electrodes to produce pilot discharges that ionize a gas there between and thereby reduce the voltage necessary to ignite a primary discharge between the primary electrodes. Power is provided to the secondary electrode by a circuit which is independent of the circuit that supplies power to the primary electrodes and generates voltage pulses which are substantially higher than the voltage between the primary electrodes.

18 Claims, 6 Drawing Sheets

U.S. PATENT DOCUMENTS

| | | | |
|---|---|---|---|
| 4,918,590 | A | 4/1990 | Ohtuka et al. |
| 5,043,636 | A | 8/1991 | Klopotek et al. |
| 5,711,859 | A | 1/1998 | Caramel et al. |
| 5,993,761 | A | 11/1999 | Czernichowski et al. |
| 6,007,742 | A | 12/1999 | Czernichowski et al. |

FOREIGN PATENT DOCUMENTS

| | | |
|---|---|---|
| CH | 378296 | 6/1964 |
| FR | 2 049 269 | 3/1971 |
| FR | 2593493 | 7/1987 |
| FR | 2 639 172 | 5/1990 |
| FR | 2724806 | 3/1996 |
| FR | 2 775 864 | 9/1999 |
| GB | 2172011 | 9/1986 |
| PL | 172152 | 7/1995 |
| RO | 112225 | 6/1997 |
| WO | WO-9426656 | 11/1994 |
| WOWO | PCT/GB94/01818 | 3/1995 |

OTHER PUBLICATIONS

Lesueur, et al., "Electrically Assisted Partial Oxidation of Methane", *Int. J. Hydrogen Energy*, vol. 19, No. 2, (1994), 139-144.

Meguernes, et al., "Oxidization of CH4 by H2O in a gliding electric arc", 3rd European Congress on Thermal Plasma Processes, Aachen, Germany, Sep. 19-21, 1994, abstract No. 80; full text in *VDI Berichte* 1166, (1995), 495-500.

Alemu, Office Action for U.S. Appl. No. 09995125 sent May 07, 2003, 1-6.

Nave, Office Action for U.S. Appl. No. 09005647 sent Jan. 13, 1999, 1-7.

Nave, Office Action for U.S. Appl. No. 09144318 sent Mar. 17, 1999, 1-10.

Petit, PCT Written Opinion for PCT/US98/18027 sent Jul. 16, 1999, 1-4.

Clement, PCT International Search Report for PCT/US98/18027 sent Jan. 04, 1999, 1-5.

Mayekar, K. PCT International Search Report for PCT/US98/00393 sent May 04, 1995, 1-4.

Jorgensen, et al., Abstract of FR2593493, (Dec. 10, 2007), 1.

Abstract of FR2724806, DialogWeb DERWENT database search results for English-lanuage, printed on Jan. 25, 1999, 1-2.

Esp@cenet Automated translation of Description and Claims of CH378296, (Dec. 10, 2007), 1-4.

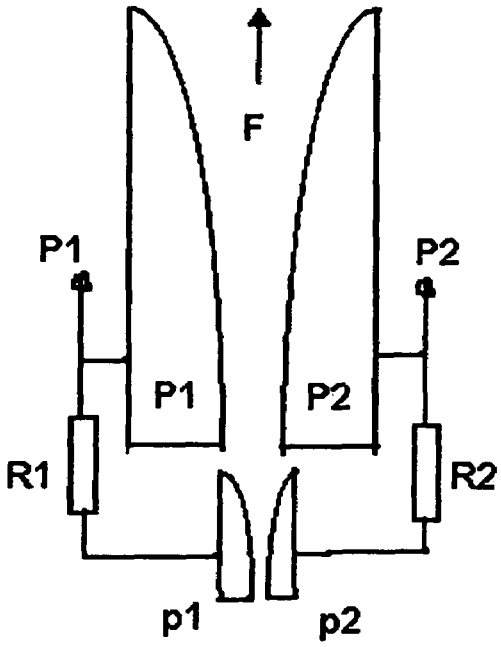
a)
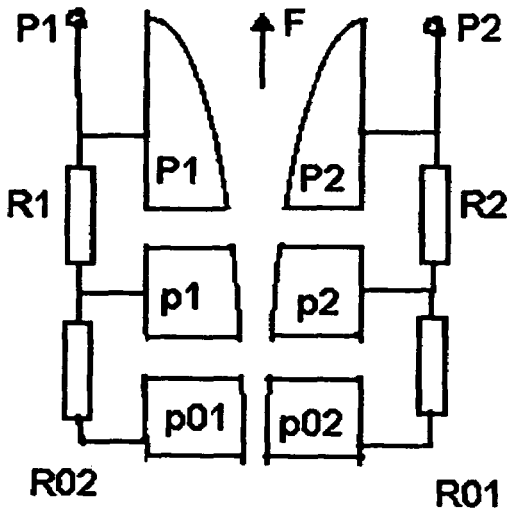
b)
Fig. 14
Fig. 15a
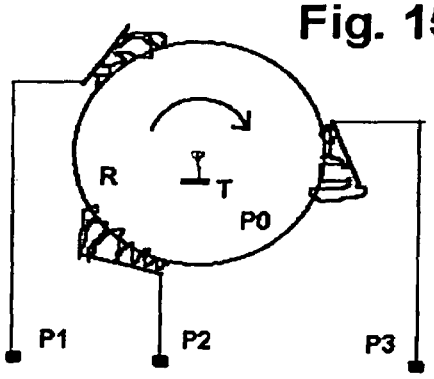
Fig. 15b
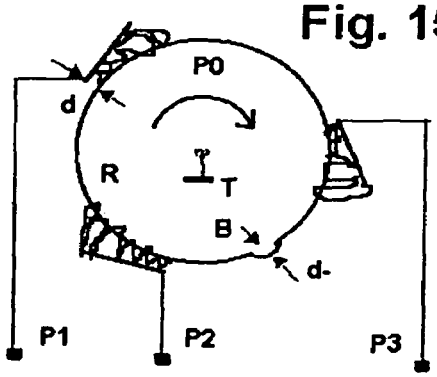

SYSTEMS AND METHOD FOR IGNITION AND REIGNITION OF UNSTABLE ELECTRICAL DISCHARGES

CROSS-REFERENCE TO RELATED APPLICATIONS

This is a continuation application of U.S. patent application Ser. No. 09/995,125, filed Nov. 27, 2001 now U.S. Pat. No. 6,924,608, and claims foreign priority benefits under 35 U.S.C. 119(a)-(d) or 365(b) of French Application No. 00.15537 filed on Nov. 27, 2000, entitled, "Systems and Methods for Ignition and Reignition of Unstable Electrical Discharges" which are hereby incorporated by reference as if set forth herein in their entirety.

SUMMARY OF THE INVENTION

The present invention relates generally to the ignition and reignition of unstable electrical discharges between electrodes, and more particularly to systems and methods using an intermediate electrode to ignite and reignite discharges between a set of electrodes wherein it is desirable to maintain the discharges with a lower power than is necessary to ignite or reignite the discharges.

The ignition and maintenance of an unstable electrical discharge intended to glide along a pair of electrodes using relatively low power poses an interesting problem. In order to ignite the discharge between the electrodes, a high voltage is required. The voltage must be sufficient to cause breakdown of the impedance between the electrodes so that discharge (arcing) occurs. Once the discharge is established, however, it is desired to have the discharge continue at a relatively low power. This creates a need for complex power supplies to regulate the voltage and/or current between the electrodes.

The present invention provides an alternative to the complex power regulation schemes that have previously been necessary in gliding discharge systems. Rather than focus on the control of the voltage and current of the power supply feeding the discharge, the present invention focuses on reducing the need for such complex power supplies. This is achieved, in very basic terms, by providing an intermediate electrode which lies between a set of primary electrodes. Because the distance between the intermediate electrode and each of the primary electrodes is less than the distance between the primary electrodes themselves, less voltage is required to cause electrical breakdown and ignition of a discharge between the intermediate electrode and the primary electrodes. Once a discharge has been established between the intermediate electrode and each of a pair of primary electrodes, the discharges can effectively be joined to form a discharge between the pair of primary electrodes. Thus, the desired discharge can be achieved without having to deal with the higher threshold voltage that would have been required in the absence of the intermediate electrode.

This is only a brief, generalized description of the invention. The detailed description that follows will more clearly depict a preferred embodiment of the invention, as well as provide a more clear indication of the scope of the invention.

BRIEF DESCRIPTION OF THE DRAWINGS

Other objects and advantages of the invention may become apparent upon reading the following detailed description and upon reference to the accompanying drawings.

FIGS. 14*a* and 14*b* are diagrams illustrating electrode structures in accordance with one embodiment of the present invention.

FIGS. 15*a* and 15*b* are diagrams illustrating alternative electrode structures.

Figure 1:
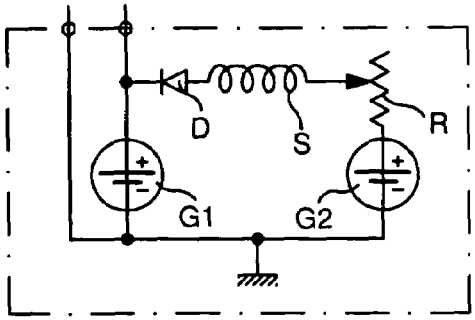
Fig. 1 PRIOR ART
FIG. 1 is a circuit diagram illustrating a power supply in accordance with the prior art.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION

The invention described herein proposes several power generators and electrical circuits to feed highly unstable high-voltage discharges.

One of these discharges, referred to as GlidArc, was previously proposed for multiple industrial applications. Several GlidArc discharges can be interrelated within a single device. Therefore, the invention described herein also proposes generators and circuits to feed certain structures with multiple discharges.

For a plasma-chemical process, such as the destruction of molecules of airborne pollutants or the conversion of a gas containing hydrocarbons, the beneficial action of "cold" electrical discharges has long been demonstrated in the scientific literature. A specific nonequilibrium plasma generator was designed, see BF 88.14932 (2639172), by H. Lesueur, A. Czernichowski, and J. Chapelle, to process significant flows of gas circulating at very high flow rates near a system of stationary electrodes. It was observed that such dual electrode module (since then, referred to as GlidArc-I) was capable of developing an output of up to approximately 5 kW before this simple discharge was transformed into a thermal source considered inappropriate for the processing of gases. Thus, in order to process a significant volume of gas, it was necessary to use a battery consisting of several modules, each of which was fitted with a gas acceleration system located near the electrodes, and with a power supply.

In order to avoid such acceleration of the gas for some applications, a new principle was designed: electric discharges gliding along mobile electrodes, see BF 98.02940 (2775864), by A. Czernichowski and P. Czernichowski. This device, called GlidArc II, contains a minimum of two electrodes, at least one of which must be mobile. As before, the multiple electrode structures were designed for the processing of significant gas flows in multi-stage systems, where each discharge is fed by a specific electrical generator.

The original power supplies of these GlidArc-I or -II discharges are based on a direct or alternating current power supply and current limited by series impedance. This impedance must limit the strong surge during the ignition phase. The absence of such impedance would produce a dead short circuit, along with all of its adverse consequences for the device and the power supply system. Three types of impedance can be considered:

- resistance, which produces a significant loss of energy if it dissipates outside of the reactor in the form of Joule's heat, which is of little use for the process,
- capacitance, which is discharged very violently once that the ignition path is established and, therefore, changes the nature of the discharge, which becomes excessively thermalized and thus inappropriate for the "cold" plasma-chemical process,
- series self-inductance, which transforms a voltage generator into a current generator, which appears to be appropriate.

We originally decided on self-inductance. This simple assembly makes the high ignition voltage that is required for the quasi-cyclical operation of the GlidArc readily available. In fact, the limitation of current by the inductive effect does not appear to create any technological problems. Furthermore, "leak" transformers are commercially available. These transformers (e.g., 15 kV no-load voltage and 15 kVA power) are capable of withstanding dead short circuits, adapting to the variable load, and tolerating a significant surge. However, they show a very poor power factor (sometimes expressed as $\cos \phi$) of the order of 0.1 to 0.2, which must be offset in order to increase the power factor to about 1, through the use of parallel capacitors. This involves an additional investment, without however solving the problem of the low power transmitted to the GlidArc in relation to the installed power (from 10 to 20%), thus resulting in a high investment cost. We have eliminated or, at the very least, mitigated these defects in the new generators and power supply circuits, which constitutes the subject of this invention.

The detailed description of this GlidArc discharge, which is extremely unstable by design, should make it possible to solve the problems related to its supply and thus understand the characteristics to look for in a higher-performance power supply for industrial scale reactors.

The principle of the GlidArc (both I and II) is based on a quasi-periodic ignition—spreading—extinction sequence of a series of electrical discharges with limited current. We recommend the use of currents lower than 5 Amps in order to remain within the range of a "self-sustained discharge," which has not yet been clearly defined and is still poorly known to science, as it is comprised between "luminescent discharges" and "electric arcs."

At least two electrodes are in contact with the discharge. The legs of the discharge (i.e. galvanic contacts communicating with an electrical power supply of the discharge) glide over these electrodes to prevent their thermal erosion and/or chemical corrosion. The gliding of the legs of the discharge is caused by a quick movement of a flow (gas, vapor, with or without powder or droplets, etc.) across the electrodes (GlidArc-I), or by the mechanical movement of at least one of the electrodes (GlidArc-II). Regardless of the movement's origin, the discharge column spreads fairly quickly and, as the distance between the electrodes is not constant, it increases as the legs move. We also observe that it is somewhat difficult to move the legs of the discharge, and that the column, which is very long compared to the position of the legs, is what causes the legs to jump towards another position, thus shortening the column . . . This increase of the distance between the electrodes, which causes the quasi-progressive spreading of the discharge, is complemented by very quick fluctuations of the column that is moving across a flow that is often turbulent. These fluctuations are similar to the meanders of a river, with the same bends, short circuits, and deviations from the old bed, except that they occur in a very short time.

Moreover, the discharge column may change its diameter following a periodic oscillation of the current feeding the discharge, e.g. an alternating current that goes several times through a value of zero without causing the column to disappear. The column can also change its diameter following electrical current oscillations caused by active components of the power supply circuit . . .

According to the very principle of the GlidArc, we do not attempt to reduce the quasi-progressive change or the "meandering" of the length of the column, nor do we limit the fluctuations of its diameter by eliminating the oscillations of the electrical current . . . On the contrary: we cause and/or maintain all of these column instability phenomena in order to obtain a medium characterized by a significant electrical and dynamic nonequilibrium of a quasi-random flow—as this enables us to obtain a highly thermodynamically nonequilibrium medium that is appropriate for the treatment of the material constituting the flow in close contact with the electrical discharge.

All of these instability features must be accepted, maintained, or even reinforced by an electrical power supply. This should be some type of black box that "sees" the discharge on one side and, on the other side, is connected to an industrial power supply (e.g. 400 V three-phase mains). Such transmission box must be as simple (for reasons of economy, durability, etc.) and as performing (transformation efficiency, filtering of electrical discharges not compatible with the mains, etc.) as possible.

To simplify, let us consider in detail the life cycle of such discharge between two electrodes only (several electrodes in a multiphase structure can also be involved in a more complex discharge). Naturally, the two electrodes (referred to as power electrodes) are set distant from each other, otherwise there would be a dead short circuit. The shortest distance between the electrodes must be at least several millimeters, otherwise it would be very difficult to adjust this distance with accuracy, as the electrodes and their supports are placed inside a reactor, such as a chemical reactor, and therefore are not very accessible. Furthermore, we wish to prevent the slight wear of the electrodes, or the roughness that may develop on their surface, from causing a relatively significant change of said distance in relation to the initial setting. It is at this shortest distance that we observe an electric ignition when the voltage applied to the electrodes exceeds the dielectric breakdown voltage in the flow comprised between the electrodes. Immediately after this breakdown, a small volume of plasma formed between the electrodes is carried by the movement of the gas (GlidArc-I) or by the movement of one electrode in relation to the other (GlidArc-II; in this case, the movement may be helped by the flow of gas or other diluted material). The rate of travel of the discharge depends mainly on the flow rate and/or rate of mechanical displacement of one (or both) electrode(s). The discharge column begins to spread since, according to the very principle of the GlidArc, the distance between the electrodes increases in the direction of flow (e.g. the electrodes are diverging). At the same time, the voltage at the terminals of the electrodes increases, in an attempt to offset the loss of energy through the column that is growing longer. During this phase, the discharge (or rather a quasi-arc) is in a state of near thermodynamic equilibrium, meaning that at each point of the plasma, the temperature of the electrons is close to the temperature of the gas. This state results from the high frequency of collisions between electrons and molecules; the electrical power supplied per unit of length of the discharge is sufficient to offset the radial losses suffered by the column due to thermal conduction. This balancing phase continues while the discharge keeps spreading until the power that can be supplied by the power generator feeding the discharge reaches its maximum value. From that point, while the thermal conduction losses keep increasing, the discharge enters its thermal nonequilibrium phase and a significant drop is observed in the temperature of the gas. However, the temperature of the electrons remains very high. Following the drop in gas temperature, the heat losses decrease, and the length of nonequilibrium plasma can then continue to grow until the heat losses exceed the power available in the discharge. Then, the discharge is extinguished and a new discharge is established at the spot where the two electrodes are closest, and the cycle of ignition, life, and extinction is repeated.

Therefore, in order to operate, the GlidArc reactor needs special power generators. The generator must supply a voltage high enough to ignite the charge and, then, when the voltage of the discharge drops, it must supply a limited power. Thus, its current-voltage characteristic must "drop" quickly after the ignition.

The second phase of the discharge's life, i.e. thermal and electrical nonequilibria during which up to 80% of the power is injected, is especially interesting for the purposes of stimulating a chemical reaction. The active discharges thus created in the GlidArc devices can sweep almost the entire flow. In the GlidArc-I device, the flow of material (e.g. gas) moves across the column at a slightly lower velocity than the flow that is pushing it. In the GlidArc-II, it is no longer necessary to accelerate this flow near the electrodes, as the velocity of travel of the discharge is determined by the movement of one electrode . . . Thus, almost all of the flow is exposed to the electrons, ions, radicals, and particles energized by the discharge. This makes it possible to obtain the desired chemical effect. Following a quick scattering and aerodynamic turbulence, these active species, which have a relatively long life, even manage to spread over the space that is not directly touched by the discharges. These phenomena also contribute to the extraordinary activity of these GlidArc discharges.

The nature of the current and voltage of the GlidArc is such that even their measurement requires special attention. In particular, the significant and quick variations of voltage ($10^{-10}$ V/s) and current ($10^{-8}$ A/s) during both the ignition and the extinction of each discharge, cause electrical interference. Of course, these same phenomena can be sensed by a non-protected generator feeding such electrical discharge.

It is usually possible to establish mathematical models to describe the physical phenomena and the properties of electrical discharges. These take into account the evolution in time and space of the specific parameters of the plasma, such as diffusion, electrical conductivity, thermal conductivity, viscosity, etc. Thus, there are 3 types of models: microscopic (energy balance of all levels of all components), intermediate (energy balance in the discharge column described by the Elenbaas-Heller equations, which can be simplified by taking into account the radiation and convection phenomena), or yet simplified further by maximum reductions of the energy balance (Cassie, Mayr, or Brown models where the plasma constitutes the variable conductance electrical discharge) . . .

However, in spite of our efforts over long years of research, we were not able to propose an analytical description that would provide an adequate representation of GlidArc type discharges. We have hundreds of records showing the high temporal resolution Volt-Ampere characteristics provided by high-speed digital oscilloscopes connected to computers, the characteristics in different gases flowing under different flow rates, pressures, temperatures, for discharges between electrodes of different sizes and materials, fed by various power supplies . . . but, unfortunately, we cannot use them to design a power supply that would be sufficiently compatible with such sources of instability . . . well maintained for the "chemical" reasons. Therefore, it was necessary for us to invent new power supplies that could accommodate said GlidArc discharges.

In general, a GlidArc can be supplied with rectified direct current, single-phase alternating current, three-phase alternating current, or multiphase alternating current. As mentioned above, the GlidArc operates in a discharge state, compared to a conventional electric arc, with relatively high voltages (several kilovolts) and weaker currents (a few amperes). Thus, for the same electrical power, the intensity of the currents is much lower than in a conventional plasma torch. The voltage increases following the extension of the discharge channel. This extension is due to one or several causes, such as:

- the high turbulence of the medium where the discharge develops,
- the distance between the electrodes,
- the non-thermal conduction of the current through the medium.

In broad outline, the electrical power supply of a GlidArc must perform two functions: 1) ignite the discharges, and 2) deliver the electrical power into the discharge.

The following description will explain the mode of operation of the GlidArc discharge in relation to power supplies that have been previously used or described in the literature. To this effect, we will mention problems related to these power supplies, which will enable us to better position our new power supplies and circuits (assemblies), which are the subject of this invention.

FIG. 1 shows a mode of operation of the GlidArc-I that was previously described in BF 88.14932 (2639172). The direct current supply consists of two generators (G1) and (G2) connected in parallel to the terminals of two electrodes. The generator (G1) delivers the voltage necessary to ignite the discharges (~5 kV) for a current limited to 1 A. The generator (G2) delivers the power necessary to maintain the discharge while it is spreading. The voltages and currents can be limited to values of up to 800 V for the voltage, and 60 A for the current (which is unusually high for a purely thermal application). A resistance (R) adjustable between 0 and 25 Ω, and a self-inductance (S) of 25 mH are connected in series between the positive terminal of the generator (G2) and an electrode, in order to limit both the direct current component and the current variations. Furthermore, a cutoff and protective diode (D) is placed in series with the resistance (R) and the inductance (S) in order to protect (G2) from the voltage delivered by (G1). The diode (D) will become conducting only when the voltage in the terminals of the electrodes is lower than or equal to the voltage measured at the terminals of the generator (G2) (immediately after the ignition of a discharge). The limitation of the current by the resistance (R) and inductance (S) makes it possible to maintain the discharge state below the arc state that does not allow for the proper operation of the device. The negative terminals of the generators (G1) and (G2) are interconnected and constitute the negative terminal of the power supply, which is connected to the other electrode.

Figure 2:
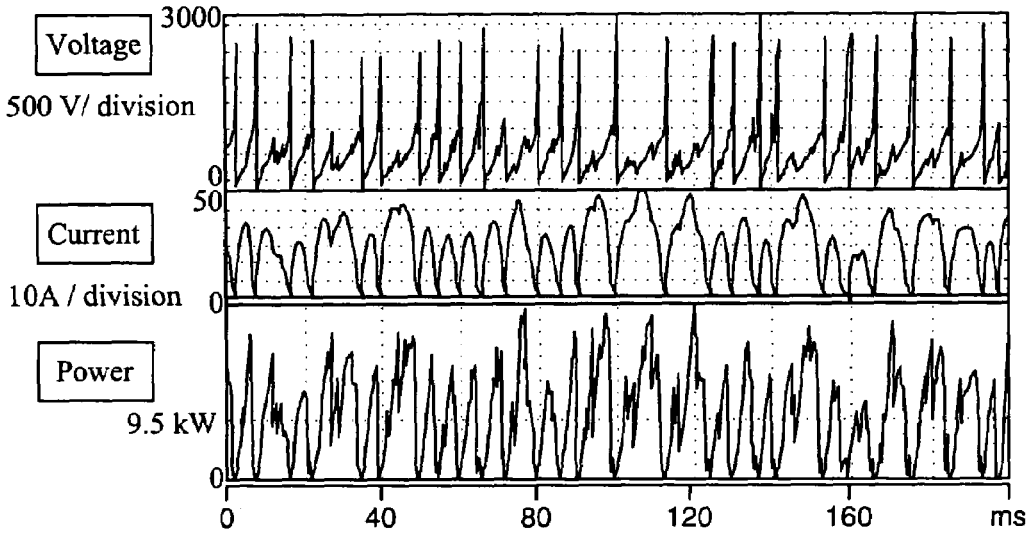
Fig. 2 PRIOR ART
FIG. 2 is a diagram illustrating the variations of voltage, current and instantaneous power in the power supply of FIG. 1.

FIG. 2 shows the variations of voltage at the terminals of the two electrodes, the variations of current, and the variations of the instantaneous power, respectively, which are plotted in relation to time for an average output of 9.5 kW and an airflow of 120 $m^3$(n)/h. The air is channeled by a cylindrical conduct with an inside diameter of 85 mm, where two steel electrodes are attached. This recording was obtained with a digital oscilloscope. It shows a sequential process; the life of a discharge is approximately 6 ms, the mean current is 20 A, and the mean voltage is 480 V. The duration of a quasi-period can be extended or shortened according to the linear speed of the gas in the area between the electrodes, the nature of the flow, and the geometry of the GlidArc.

This FIG. 2 shows that, at the time of the ignition of the discharge, the dielectric breakdown voltage, which is a function of the shortest distance between the electrodes, should be in the order of several kilovolts while the current intensity does not need to be high. Unfortunately, it was not possible to lower this voltage by bringing the electrodes closer together, as these must remain separated at least by a few millimeters due to mechanical reasons. In fact, metal scales or deposits of any origin could produce short circuits.

Figure 3:
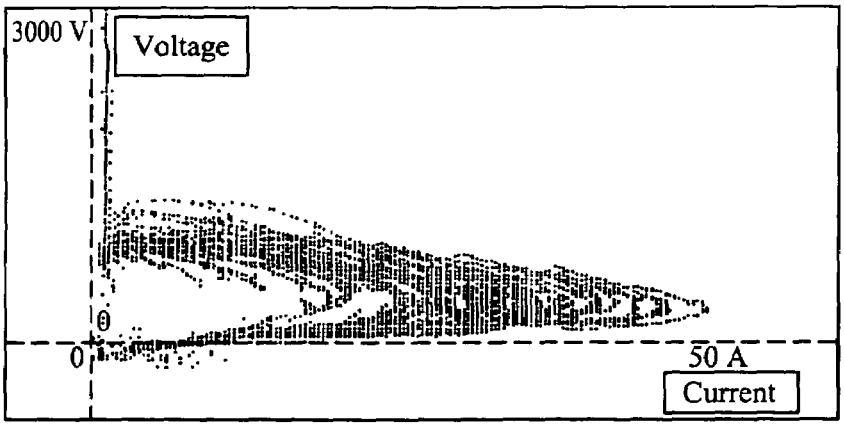
Fig. 3 PRIOR ART
FIG. 3 is a diagram illustrating the variations in current and voltage under the operating conditions of FIG. 2.

Therefore, the gliding discharges have variable characteristics from the time that they are ignited to their extinction, with, in particular, energy dissipation values that increase over time (and which may reach values comparable to those of the arc state). In FIG. 3, we plotted the "cloud" of experimental points originating from the current-voltage characteristic (shown in FIG. 2), which corresponds to the preceding operating conditions. This characteristic highlights the turbulent and discontinuous operation of this discharge. This is precisely the type of operation that makes it possible to obtain a relatively cold (or warm) plasma that is in highly thermodynamic nonequilibrium.

Therefore, our observations indicate a significant drop in voltage between the electrodes immediately after the ignition. Although this voltage increases along the path of the discharge between the diverging electrodes, it is never as high as the voltage achieved between the electrodes at the time of the first breakdown. In fact, the voltage required by the successive breakdowns is not as high as that required for the first breakdown, unless there is an extended interruption causing a partial deactivation of the ions that are present between the electrodes and which facilitate the successive reignitions. Finally, the mean voltage between the electrodes is comprised between a few hundred volts and 2 kV, depending on the nature of the gas, its temperature and pressure, the distance between the electrodes, the shape of the electrodes, etc. By definition, this voltage is much too low in relation to the voltage required for the ignition and, therefore, it appears that a "conventional" continuous voltage power supply would be difficult to apply. Thus, the power supply shown in FIG. 1 presents several drawbacks:

- the use of the resistance (R) to limit the current in the main power circuit causes substantial Joule losses in the form of heat unnecessarily dissipated outside of the GlidArc,
- the mean current is too high and the mean voltage too low to obtain a true nonequilibrium plasma source for some chemical conversions; this puts us rather in the area of an electric arc,
- two continuous power sources must be obtained (G1) and (G2) while the power distribution system is always alternating 50 (or 60) Hz,
- it is difficult to feed several electrodes from a single generator of this type.

Another type of electrical power supply was used in our numerous laboratory-based experiments. It is based on a system of "leak" or "lighting" transformers (single-phase 50 Hz, 230 V primary current, 10 kV secondary current, 1 kVA, inductive limitation of secondary current of 0.15 A). These are special single- or multiphase transformers with an increased magnetic resistance between the primary winding and the secondary winding (i.e., by separation). Several single-phase transformers can be interconnected within a three-phase circuit (system) to feed 3 or 6 electrodes, at different power levels (transformers placed in parallel) for "open circuit" effective voltages of 10 kV (or 5 kV) between each pair of electrodes set opposite each other, or 17 kV (8.5 kV) between adjoining electrodes (24.5 kV or 12.2 kV peak). This type of power supply is not optimal for potential industrial applications. The efficiency of these transformers is low (10-20%) because they operate for the most part under voltages that are much lower than their open circuit voltage. We also observed some loss of energy reflected by the heating of these transformers. This loss was measured in a "dead short circuit" state for two typical situations:

3 transformers, 3 kVA installed, power loss=0.58 kW,
6 transformers, 6 kVA installed, power loss=0.90 kW.

Instead of "leak" transformers, it is possible to use "rigid" transformers and separate self-inductances placed in series. In order to increase the output of such power supply, the power transformer could be linked to several pairs of electrodes connected in parallel. In this case, each branch must be separated from the secondary circuit by a series inductance. These inductances are used to charge their respective branches with a significant voltage drop (80-90% of transformer's rated voltage). Thus, the reactive power losses cannot be prevented.

Therefore, this type of power supply for GlidArc discharges has several drawbacks. In particular, their reactive power requirements are high because the initial voltage required to ignite the discharge is high. An electric field of at least 3 kV per mm of spacing between the electrodes is already required for a reliable ignition between the electrodes and in a gas (such as air) circulating at atmospheric pressure. This value is even greater for higher pressures or gases such as $H_2S$ or $SO_2$ that capture free electrons. The ratio between the open circuit voltage and the mean voltage of the discharge in operation is quite high, meaning that the installed (reactive) power is much greater than the effective (active) power. In most cases, the latter should occasionally reach up to several tens or hundreds of kW for industrial applications, although we observed that only a small fraction of the "installed" power is actually transmitted towards the discharge. It rarely exceeds 30%, even for a GlidArc that has been optimized in terms of material flow and distance between the electrodes (which, as mentioned above, should be at least a few millimeters, otherwise the adjustment would be inaccurate or altered by the possible deposit of substance treated in a GlidArc reactor). Some capacitors were sometimes connected at the power intake in order to correct a very poor power factor. After the ignition of the discharge under the "open circuit" voltage applied to the electrodes and exceeding the dielectric breakdown voltage, this high open circuit voltage no longer helps in maintaining the discharge. However, a "leak" transformer must be build in order to support this voltage. Therefore, the solution providing for the separation of the ignition function from the discharge maintenance function, like the one presented in FIG. 1, appears to be the most beneficial.

Figure 4:
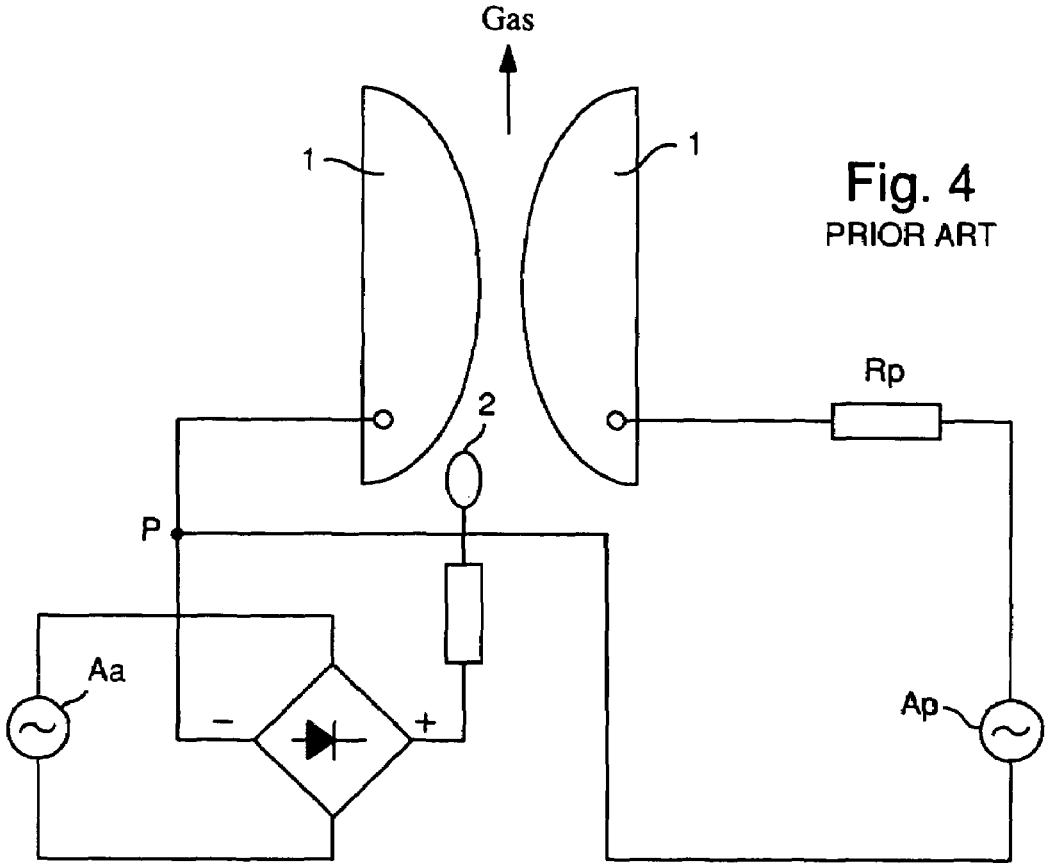
Fig. 4 PRIOR ART
FIG. 4 is a diagram illustrating an alternative power supply in accordance with the prior art.

Another solution to the power supply problem was proposed by J. E. Harry in a patent WO95/06225. FIG. 4 summarizes this solution, where an additional electrode (2) is placed between the two primary electrodes (1). The use of this third high voltage electrode, separated from the main power supply (Ap) which has a lower voltage, would make it possible to increase the separation between the power electrodes. The two primary electrodes (1) are fed by a main alternating current generator (Ap). An ignition electrode (2) fed with rectified current drawn from an auxiliary power supply (Aa) with an output of less than 500 W is positioned in an asymmetrical manner between these two electrodes. The two power supplies are connected by a common point (P), so that the dielectric breakdown voltage is exceeded between the electrode (2) and one of the two electrodes (1). A relatively powerful spark (with a current of approximately 0.1 A) can thus be generated, causing the ionization of the gas near these electrodes. This is sufficient to establish a main discharge between two electrodes (1). Thus the open circuit voltage of the main generator (Ap) could be reduced by half. However, FIG. 4 shows the presence of a resistance (Rp) in series in relation to the main power circuit; therefore, it constitutes a source of energy loss in the form of Joule's heat dissipated outside of the GlidArc device.

Figure 5:
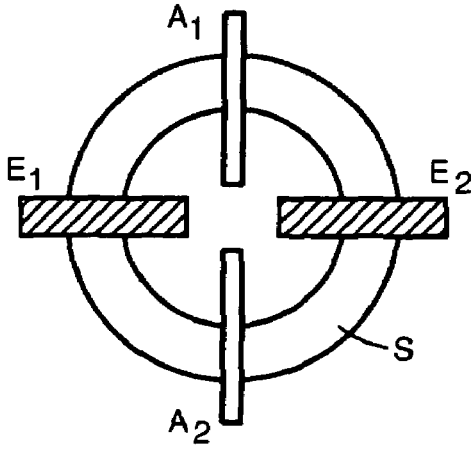
Fig. 5 PRIOR ART
FIG. 5 is a diagram illustrating an electrode structure in accordance with the prior art.
Figure 6:
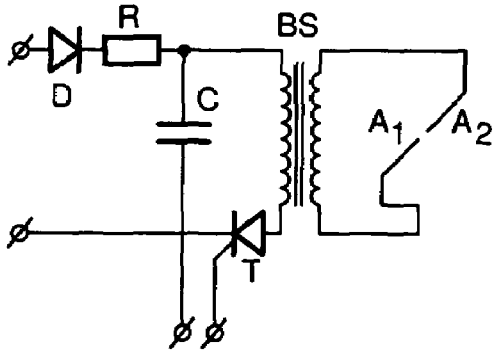
Fig. 6 PRIOR ART
FIG. 6 is a power supply configured for use with an electrode structure as shown in FIG. 5.

Another solution to the discharge ignition problem was proposed in a Romanian application No. 112225B (1994) by E. Hnatiuc and B. Hnatiuc. The solution presented in FIG. 5 consists in placing two auxiliary electrodes ($A_1$) and ($A_2$) between the primary electrodes ($E_1$) and ($E_2$). These auxiliary electrodes are independently fed from an additional power supply that is similar to that used for the electronic ignition of an automobile, see FIG. 6. It is a high voltage, low output power supply. This power supply enables the ignition of a "pilot" electrical discharge that pre-ionizes the space between the primary electrodes ($E_1$) and ($E_2$), and provides for the ignition of the main discharge at much lower supply voltages. This makes it possible to increase the energy output of the power supply up to 70%. The operation of this GlidArc-I device is controlled and adjusted through the modification of the phase of control pulses applied to the control grid of a thyristor (T) placed in the primary of an induction coil (BS) of which the secondary is connected to the auxiliary electrodes ($A_1$) and ($A_2$). The control pulses are generated by an integrated circuit. The electrical power supply assembly also contains a reactance coil (R) in series to limit the current in the main circuit.

However, for some applications, it could be difficult to add two auxiliary electrodes in the ignition area for the GlidArc-I reactor. Furthermore, this principle cannot be used to feed the GlidArc II type reactor. The adjustment of the distance between the primary electrodes (changing the performance of the device) and the simultaneous adjustment of the position of the auxiliary electrodes present significant technological problems.

Figure 7:
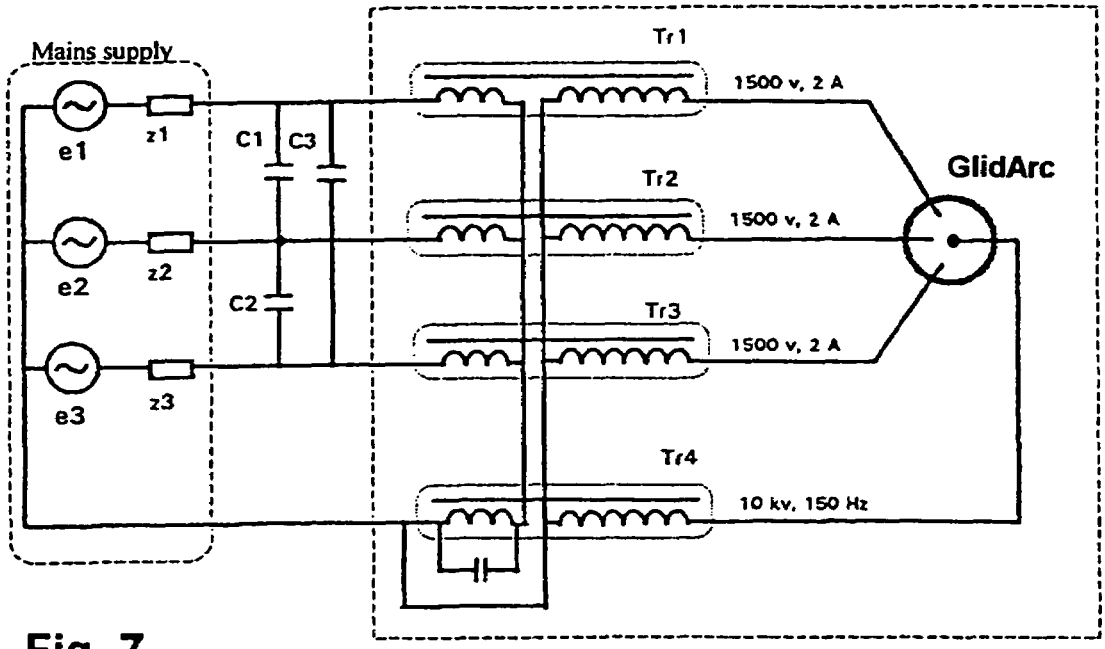
FIG. 7 is a diagram illustrating a power supply which is based on three single-phase transformers.

Another electrical power supply for the GlidArc was proposed in a Polish patent PL301836A1 (1994) by T. Janowski and D. Stryczewska. FIG. 7 shows this solution, which is based on three single-phase transformers (Tr1), (Tr2), and (Tr3) supplied with 230 V by three phases (e1), (e2) and (e3) of the star-connected system, 50 Hz, 400 V. Thus, the three primary electrodes of the GlidArc are fed a three-phase current of medium voltage up to approximately 2 kV, with the possibility of adjusting this voltage (and, therefore, the dissipated power) within a range of approximately 10%. Three capacitors (C1), (C2) and (C3) are installed upstream from the power supply in order to correct the power factor. These main transformers have an inductive nature, which is marked by the series inductances (z1), (z2) and (z3). A fourth transformer (Tr4) recovers a very low pulsation due to the near magnetic saturation of the cores of the main transformers, between the floating node of the main circuit of (Tr1), (Tr2) and (Tr3), and the neutral of the electrical network. Thus, the primary of the power supply system has a low voltage with a triple frequency (150 Hz) which is then transformed by (Tr4) to a level of the order of 12 kV. This high voltage ignites a 20 mA discharge, thus performing the pre-ionization in the area where the three primary power electrodes are closest (approximately 2 mm). At this moment, the voltages generated by the transformers (Tr1), (Tr2) and (Tr3) act as a relay, by supplying the electrical power required to sustain the GlidArc discharges that develop between the primary electrodes, according to the rotation of the electric field. During the operation of the main discharges, the secondary of the transformer (Tr4) suffers a short circuit through these discharges.

Nevertheless, the system shown in FIG. 7 requires the use of a specific transformer operating as a near-saturated magnetic core, as it is the non-linearity of the magnetic feature of the core that produces an AC voltage of 150 Hz between the common point of the primary windings and the neutral. Without this voltage, it would not be possible to generate a high ignition voltage.

This invention proposes below several other new electric generators and specific circuits to improve the power supply of a very unstable high-voltage and relatively low current discharge such as GlidArc-I or GlidArc-II.

Figure 8:
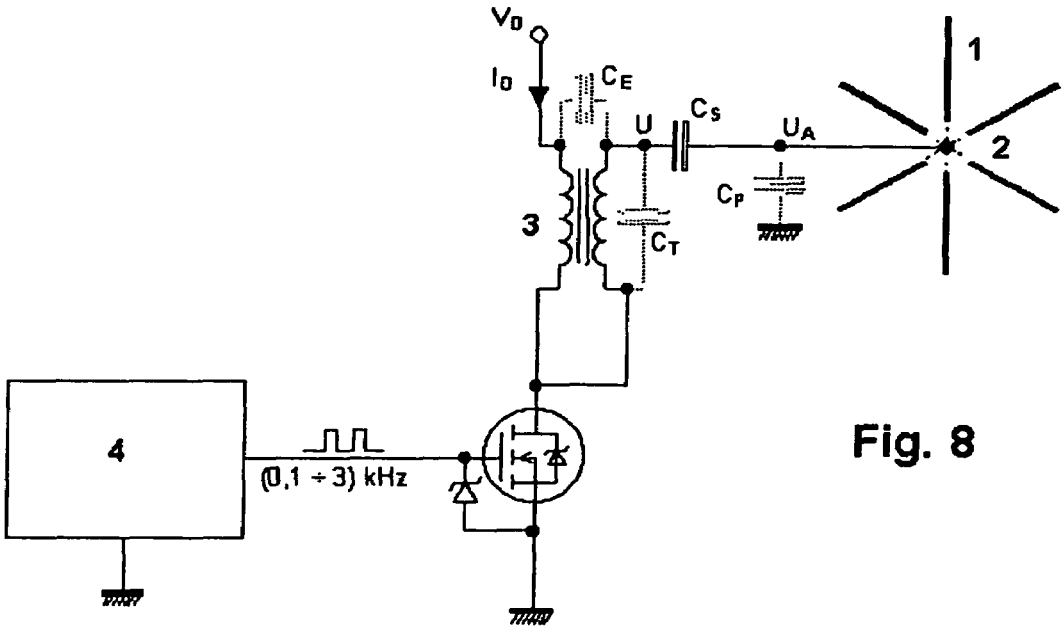
FIG. 8 is a diagram illustrating an ignition and reignition circuit which is set up independently from a main power circuit that supplies the primary electrodes of the present system.

Ignition and Reignition Electrode Set in the Geometric Center of Two or More Power Electrodes and Supplied Independently From the Main Power Circuit As shown in FIG. 8, the ignition and reignition circuit (3) and (4) is set up independently from the main power circuit that supplies the primary electrodes (1) of a very unstable electric discharge. This assembly is especially suitable for GlidArc-I type devices. It comprises an external transistorized ignition and reignition system with an additional electrode (2) set in the geometric center of two or more primary power electrodes. For example, the supply ($V_D$) of the transformer (3) is 33 V, while the separation capacity ($C_S$) is 2 nF. This assembly makes it possible to use commercial power transformers that do not need to be specifically built to provide for the saturation of the magnetic cores in order to generate a non-linear effect of which the purpose is to act as ferromagnetic amplifiers.

During the opening of the power transistor ("high level" of oscillator), the electric current intensity ($I_D$) increases according to the exponential distribution law:

$$I_D = I_0(1 - e^{-1/\tau L}) \quad (1)$$

defined by the time constant:

$$\tau_L = L_1/(R_1 + R_{DS} + R_V) \quad (2)$$

and by the balance current:

$$I_0=V_D/(R_1+R_{DS}+R_V); \quad (3)$$

where $L_1$ is the inductance of the primary winding of the transformer, $R_1$ the ohmic resistance of the winding, $R_{DS}$ the "drain-source" resistance of the transistor, and $R_V$ the internal resistance of the power supply ($V_D$). The secondary winding of the high-voltage pulse transformer (3) contains many more coils than the primary winding. Therefore, the quick variations of the magnetic flux in the core produce a strong electromotive force in the secondary circuit. Upon the interruption of the primary circuit ("high level"→"zero" transition of oscillator), the induced voltage (U) can be expressed according to the following formula (without taking into account the parasitic capacitance of the circuit):

$$U = -k\sqrt{L_1 L_2}\,\frac{dI_D}{dt},\ k\in\langle 0;\ 1\rangle. \quad (4)$$

Thus, the amplitude of the voltage (U) can be governed by:

The rate of variation of the current intensity ($I_D$); it is given by the dynamic characteristic of the transistor used;

The amplitude of current intensity ($I_D$) during the interruption of the primary circuit; as it happens, said amplitude can be controlled by the opening time of the transistor, according to formula (1).

The capacitor ($C_S$) separates the ignition circuit from the main power supply circuit: it prevents the electric current of the GlidArc main power supply from flowing, after the ignition, through the pulse transformer. Therefore, the ignition voltage ($U_A$) is reduced to the following value:

$$U_A = U\frac{C_S}{C_S + C_P}, \quad (5)$$

where ($C_P$) represents the parasitic capacitance of the cable. In order to maintain ($U_A$) at the maximum level, it is necessary to ensure that ($C_P$)<<($C_S$), meaning that the cable must be shortened as much as possible, and its insulation and path must be properly sized.

Because of the parasitic capacitance ($C_T$) of the winding of the transformer, the secondary circuit resembles an RLC oscillating circuit of which the performance depends on the quality $$Q = \sqrt{\frac{L_2}{R_2^2 C_T}}$$

of the circuit ($R_2$-resistance of secondary winding of transformer). A theoretical model of this type of oscillatory circuit with attenuation provides that if Q>½ (which was true in our experiments), the output voltage (U) is in the form of frequency oscillations $f_0=\frac{1}{2}\pi\sqrt{L_2C_T}$, of which the envelope is attenuated with a time constant of approximately $L_2/R_2$. By modifying the high-voltage pulse repetition frequency, it is possible to modify the state of the electric discharge connecting this ignition electrode with a power electrode:

If the time between two pulses is greater than the relaxation time of the oscillations, the discharge appears in the form of individual sparks, with a time separation between them.

If the time between two pulses is less than the relaxation time of the oscillations, there are no more barriers between the sparks. The discharge thus becomes continuous and resembles an alternating current luminescent discharge with a frequency $f_0$.

This last state does not appear to be beneficial for the ignition and reignition of a very unstable high-voltage electric discharge, such as a GlidArc, since the pulse transformer remains in a quasi-permanent short circuit. On the other hand, the time between two individual sparks must be significantly lower than the duration of a GlidArc cycle (ignition-extinction-reignition), in order to minimize the dead time between two discharges. Therefore, it is preferable to adjust the parameters of the RLC oscillatory circuit so that Q≈½. This provides for the fastest transmission of the electromagnetic energy of the circuit into the discharge.

During our power supply optimization tests described herein, we observed a new fact related to the shape of the ignition electrode (2). Contrary to the oblique shape proposed by J. E. Harry in FIG. 4 (taken from his patent), we propose a highly pointed shape, which is presented in FIG. 9*b*. It resembles the frame of a partially open umbrella, or a star (top view) with each branch extending towards one of the primary electrodes. This shape makes it possible to ignite discharges between electrodes that are significantly more distant from each other than those shown in FIG. 9*a*.

In fact, the distance between the primary electrodes (1) of the GlidArc-I should not vary too much from the diameter of the flow inlet nozzle. For example, for a large volume of gas, this diameter may reach several centimeters. Therefore, the distance between the electrodes must be adjusted according to this diameter and, as a consequence, the ignition voltage of the GlidArc increases. A system that may solve this problem is based on the use of an additional ignition and reignition electrode (2) placed in the ignition area, in the geometric center between the electrodes (1), of which the shape is shown in FIG. 9*b*. This additional electrode receives a very high voltage (several tens of kV), which is superimposed on the electric potential of the primary electrodes (1) by a few kV. This high voltage can be supplied, for example, by a generator presented in FIG. 8. Consequently, the spark is ignited in the electric field that rotates successively between each of the primary electrodes (the example provided in FIG. 8 shows six electrodes, each of which is connected to a 50 or 60 Hz six-phase generator) and the ignition and reignition electrode (2), thus covering the entire ignition area, in spite of minor differences in the distances between the electrodes. These very short electric discharges (typically lasting a few tens μs—depending on the nature of the ignition circuit) form a conducting zone for the ionized gas between the electrodes, which creates a current path for the main circuit, thus igniting the GlidArc-I. Furthermore, during the operation of the GlidArc-I, the ignition occurs in an automatic and selective manner: the electrode without discharge and, therefore, under a higher electric potential than the other electrodes, is the first to be short-circuited by a spark. Considering that, in this case, the main power supply may be designed for lower output voltages, its performance increases significantly.

The shape of the ignition and reignition electrode shown in FIG. 9*b* was designed after taking into consideration four different aspects:

Ignition Aspect

Figure 9:
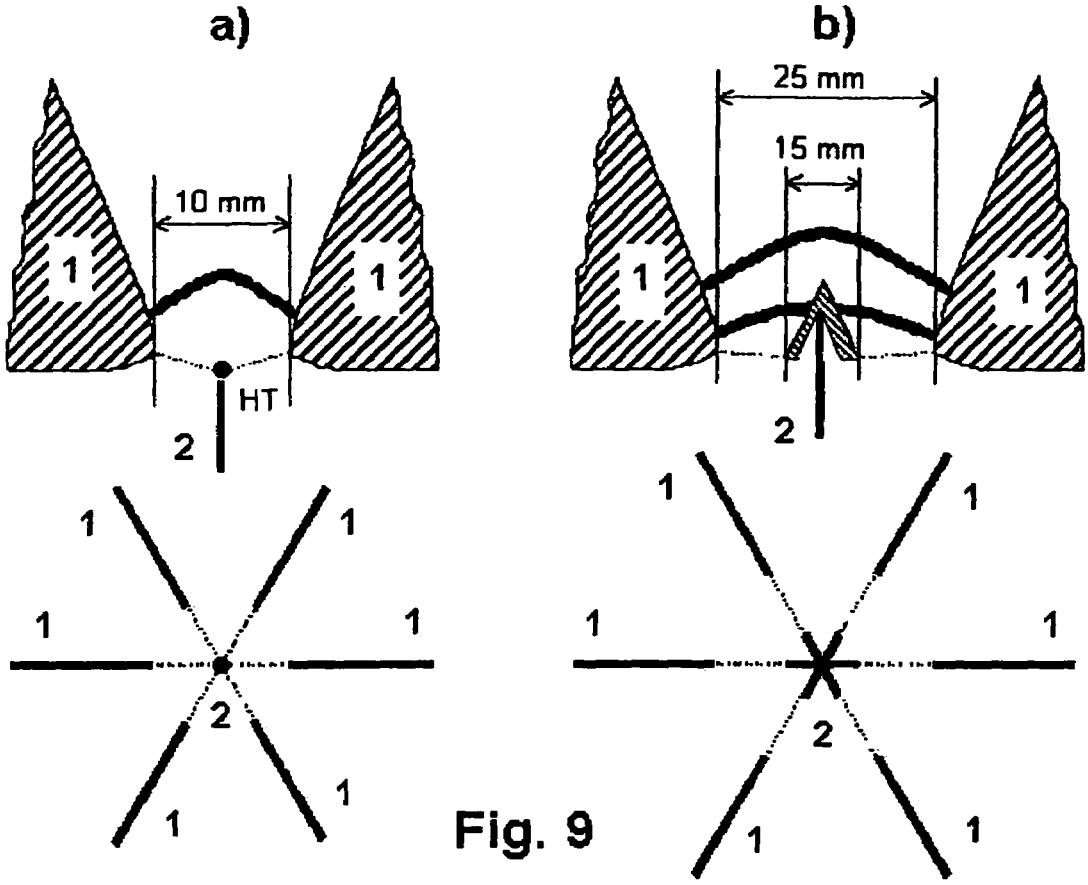
FIGS. 9*a* and 9*b* are diagrams illustrating electrode structures which include a plurality of primary electrodes surrounding a central, intermediate electrode.

The ignition and reignition electrode is shaped like a star (top view), with each of n branches (where n is the number of phases of the main power supply; FIG. 9 shows a six-phase circuit) extending towards one of the primary electrodes (1), which have such distance between them that the main discharge could never self-ignite without the electrode (2) activated by the ignition and reignition circuit. After the ignition of the GlidArc-I, this electrode acts like a short-circuit bridge between the primary electrodes: these very unstable discharges glide over the central electrode in the gas flow (FIG. 9*b*), until they meet in the middle of the electrodes. This phenomenon can be obtained because of the diverging shape (side view) of the central electrode (2.) Thereafter, the discharges spread freely between the primary electrodes (1) until they are extinguished.

Aspect of Gas Flow

The shape of the ignition and reignition electrode (2) is also adapted to the flow that runs around it. The flow runs between the branches of the star and allows the discharges to glide over the electrode without creating a flow diversion area. Thus, this shape of the electrode (2) also provides for the thermal exchange with the flow and keeps this electrode from overheating.

Thermal Aspect

The shape must also guarantee a thermal balance between the different parts of the electrode (2): this means that the electrode that heats up the quickest on the surface making contact with the discharge must be strong enough to allow for a thermal flow between the different branches. The electrical power dissipated in the central electrode (2) can be calculated according to the following formula:

$$P_{EA} \approx bn(U_C I + A\rho I^2), \tag{6}$$

I—electric current of GlidArc through one electrode, in Amperes;

$U_C$—cathodic potential drop of discharge plasma, in Volts, given by the plasma-forming gas and the electrode material used;

specific resistance of electrode material in Ωm;

A—geometric factor of electrode in $m^{-1}$;

n—number of primary electrodes (and phases feeding them);

b—factor representing the fraction of the life cycle (ignition-primary unstable discharge-extinction-reignition) of the GlidArc during which the electrical current runs through the ignition electrode. Its value can be calculated as:

$$k \approx \frac{\text{height of ignition electrode}}{\text{height of primary electrode}}.$$

In our tests k≈0.1.

The first term of the sum (6) represents the portion of electrical power due to the discharge plasma. This power dissipates on the surface of the branches of the star; therefore, a good heat dissipation towards the volume of the electrode must be provided. The second term represents the losses in the material of the electrode due to the Joule effect. It may be ignored in the case of metal materials with a very low ρ. On the other hand, for conducting refractory materials, this term can be quite significant. In fact, the dissipation of electrical power in the ignition electrode is offset by the thermal exchanges with the flow.

Aspect of Electric Field

The minimum intensity of the electric field in a gas, from which an independent discharge is ignited, is determined by the nature of the gas and the concentration of gas molecules (Paschen's law). For a distance d between two electrodes, the maximum value of the intensity of the electric field $E_{MAX}^R$ varies according to the minimum radius of curvature R of the electrodes. If we take an electric field between flat electrodes $E_{MAX}^{\infty}$=U/d for R>>d as reference, the influence of R can be determined according to the following formula:

$$\frac{E_{\mathrm{MAX}}^{R}}{E_{\mathrm{MAX}}^{\infty}} \equiv E^R = \frac{d/R}{\ln(1 + d/R)}. \tag{7}$$

With d=5 mm and for R=1 mm: $E^R$=2.8. For R=0.1 mm, $E^R$ increases to 13. Therefore, it is highly advisable to design the ignition and reignition electrode with a shape featuring tips characterized by a relatively small radius of curvature (tenths of mm). However, when they are exposed to electric discharges with high current densities, these tips can wear out during their use. Therefore, it is preferable to use metals that have a high melting point or refractory materials-electrical conductors.

B. Self-Contained Ignition and Reignition Device and Circuit Feeding Two Power Electrodes Another solution proposed in FIG. 10 pertains to the use of a special transformer as a power supply. The transformer comprises two low-voltage primary windings ($P_1$) and ($P_2$) and one high-voltage secondary winding (S). The aim of the two primary windings is to superimpose the effects produced by each primary winding onto the secondary winding (S). The first power winding ($P_1$) is connected to the mains supply, e.g. 220 V. However, the mains supply is separated by a filter (F). The second ignition winding is designed to be fed pulses of adjustable amplitude and phase. This winding has a rated voltage of 24 V, but it can withstand higher voltages of up to 200 V, for short periods of time. The filter (F) of the mains supply stops the spreading of the pulses induced from the winding ($P_2$) into the winding ($P_1$), which could otherwise spread in the mains supply. This specific transformer ($P_1$)-($P_2$)-(S) also takes into account the fact that the pulses in ($P_2$) would be ineffective in order to generate the overvoltage peaks in (S) when the electromagnetic flux is at its maximum level and the core is saturated. This is why the transformer (P1)-(P2)-(S) that we are proposing as an example shows a magnetic induction in the core of approximately 1.6 T (compared to the typical value of 1.2 T, thus approximately 30% higher). At the same time, the pulse source must be decoupled since the winding ($P_2$) becomes a source of induced voltage, which is short-circuited by the pulse source upon the application of the pulses. Therefore, this pulse source must supply a strong current to produce the highest possible peaks in the secondary S. This is why the power of the transformer that we used as an example is 6 kVA, and the pulse source (G.I.) used is a pulse generator that uses an integrated circuit.

Figure 10:
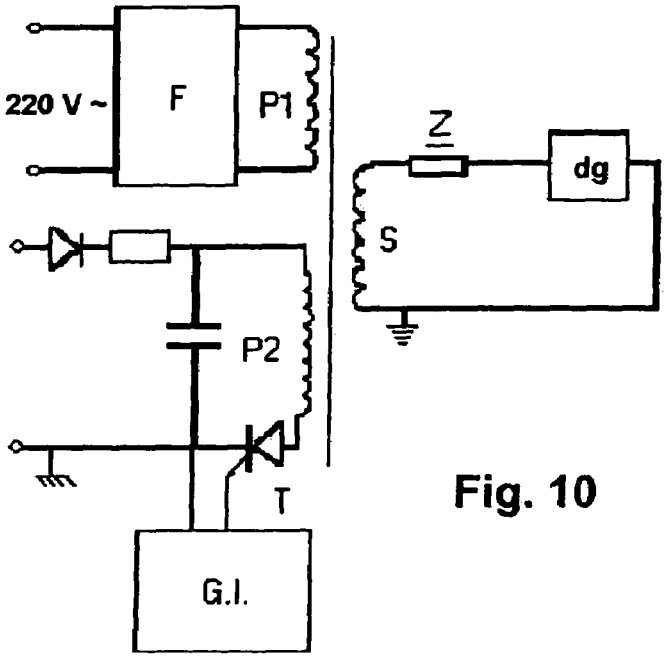
FIG. 10 is a diagram illustrating a power supply having a transformer comprising two low-voltage primary windings and one high-voltage secondary winding.
Figure 11:
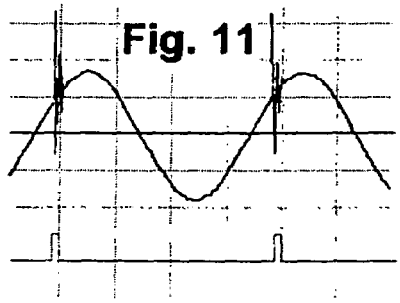
FIG. 11 is a diagram illustrating the electrical phenomena observed in the discharge corresponding to the power supply of FIG. 10.

Therefore, the assembly shown in FIG. 10 makes it possible to superimpose in the high-voltage secondary circuit (S), on the sinusoidal signal generated by the winding ($P_1$), the ignition pulses of an unstable gliding discharge (dg), which have a significant amplitude (at least the peak value of the sinusoidal signal) and a very short duration, and are induced by the winding ($P_2$). Once that the discharge (dg) is ignited by these pulses, the amplitude of the high-voltage sinusoidal signal is sufficient to sustain the evolution of the discharge. By controlling the pulse phase with the control unit of the pulse generator (G.I.), it is possible to select the moment of ignition of the discharge (dg). According to our observations, it is preferable to select this moment as close as possible to the moment where the alternating sinusoidal power voltage goes through zero. FIG. 11 shows all the electrical phenomena observed in the discharge (dg). The upper part of this figure shows the pattern of the open circuit voltage obtained in the secondary (S) of the transformer, and the lower part shows the pulses produced by the pulse generator (G.I.). The very short duration of a pulse (less than 1 ms, e.g. 0.5 ms), coupled with the energy used to generate this pulse, produces a relatively high instantaneous power of the order of 1 to 2 kW. As an additional protective measure, and by way of example, we plan to use a transformer with a 50 V insulation for the winding $P_2$ (for its supply of only 24 V), a 500 V insulation for the winding ($P_1$) which is connected to only 220 V, and a 6 kV insulation for the secondary (S), a voltage that is achieved for very short periods of time. The electrical current in the secondary circuit is limited to 1 A by a series self-inductance (Z) shown in FIG. 10. The semi-conducting components used in the primary ($P_2$) were oversized. The control pulses can also be applied to control a thyristor or power transistor.

The solution presented herein applies to all GlidArc-I and GlidArc-II structures. It can be used in multiple electrode configurations fed by a single-phase or a multiphase system such as, for example, a three-phase system. In this case, several transformers can be connected, such as the one described herein, each to a different phase. For example, for a GlidArc-II device, one pole of each of these transformers can be connected to the central electrode, i.e. the one that rotates, and the other poles can be arranged to feed the fixed electrodes located around the central electrode . . .

Figure 12:
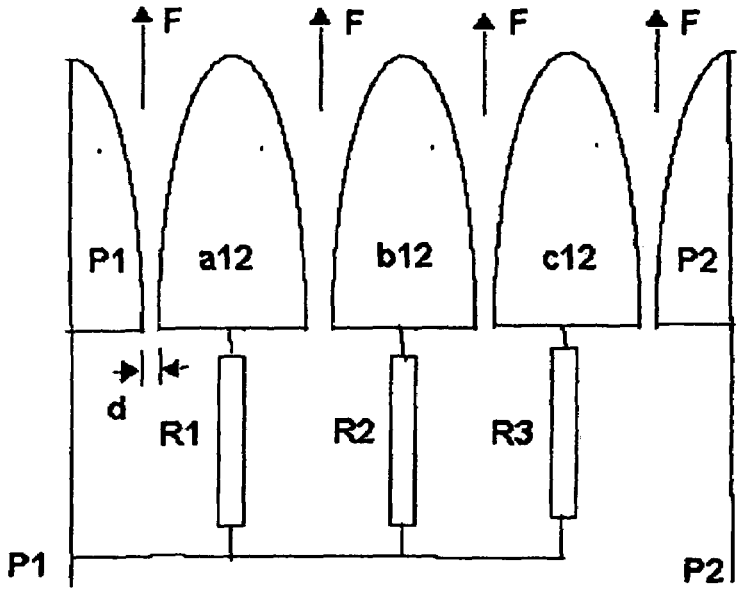
FIG. 12 is a diagram illustrating a device for the simultaneous supply of four gliding discharges connected to a single high-voltage power supply.

C. Controlled Cascade Self-Ignition Circuit Feeding Simultaneously Several Power Electrodes Connected to a Single Power Supply FIG. 12 presents another example of a device for the simultaneous supply of four GlidArc-I type gliding discharges connected to a single high-voltage power supply (a single-phase transformer or another generator of direct current, partially rectified current, pulsating current, etc.). According to this circuit, all the high-voltage electric discharges are established in series. The current delivered by the pole (P1) of a high-voltage supply connected to the electrode (P1) may only flow to the other pole (P2) of this supply if it flows through all of the series discharges (P1)-(a12), (a12)-(b12), (b12)-(c12) and, finally, (c12)-(P2).

Given the nature of GlidArc discharges, the initial ignition of these discharges must be provided through the propagation of the ignition, and then it is necessary to maintain the successive reignitions of each discharge once that they have been extinguished. This function is provided by resistances (R1), (R2) and (R3) of high value (in the order of MΩ) which connect electrodes (P1) to (a12), (b12), and (c12), respectively. Therefore, these resistances provide a galvanic connection of the circuit that would otherwise be broken, thus preventing the establishment of an initial ignition discharge connecting all electrodes placed between (P1) and (P2). This initial ignition is achieved as follows (still as an example):

The (P1) is always under a high potential delivered by the pole (P1) of the power supply. The electrode (c12) is connected to the pole (P1) by the resistance (R3); therefore, (c12) is also under the potential (P1) as the current is not yet flowing. The potential difference (P1-(P2) is sufficient for the establishment of a low-current (in the order of tens of mA) pilot discharge limited by the series resistance (R3) between the electrodes (P2) and (c12), which are separated by a distance (d). Furthermore, all distances between electrodes are more or less equal to (d).

At this time, the electrode (c12) is under a potential similar to that of (P2), since (c12) becomes connected to (P2) through the pilot discharge and, therefore, the resistance (R3) no longer determines its potential (P1) as before. At this time, it is the electrode (b12) connected to the pole (P1) by the resistance (R2), which is under the potential (P1), since the current is not yet flowing through the resistance (R2). The potential difference between (b12) and (c12) becomes sufficient to allow for the establishment of a low-current pilot discharge (still in the order of tens of mA) limited by the resistance of the discharge between (P2) and (c12), as well as by the series resistance (R2), between the electrodes (c12) and (b12). At this time, the resistance (R3) virtually stops conducting the current because the resistance of the discharge between the electrodes (c12) and (b12) is much lower than that of (R3).

At this time, the electrode (b12) is under a potential determined by the potential (P2) minus the voltage drops (which are relatively insignificant) in the pilot discharges (P2)-(c12) and (c12)-(b12). Therefore, the resistance (R2) no longer determines its potential. At this point, the electrode (a12) is connected to the pole (P1) by the resistance (R1), and it is under the potential (P1) as the current is not yet flowing through the resistance (R1). The potential difference between (a12) and (b12) becomes sufficient for a low-current pilot discharge limited by the discharge resistances between (P2) and (c12), and between (c12) and (b12), as well as by the series resistance (R1), to be established between electrodes (a12) and (b12). At that time, the resistance (R2) also virtually stops conducting the current, as the resistance of the discharge between electrodes (a12) and (b12) is much lower than that of (R2

Finally, the electrode (a12) is under a potential determined by the potential (P2) and the voltage drops (which are relatively insignificant) in the pilot discharges (P2)-(c12), (c12)-(b12) and (b12)-(a12). The resistance (R1) no longer determines its potential. The potential difference between (a12) and (P1) becomes sufficient for the establishment of a discharge between these electrodes. However, at this point, the resistance (R1) also virtually stops conducting the current, since the resistance of the discharge between the electrodes (P1) and (a12) is much lower than that of (R1). All resistances (R1), (R2) and (R3) are now practically outside of the circuit that controls the current of the discharges and, therefore, the current of all of these discharges is determined by the sum of the resistances that are specific to the series discharges (P2)-(c12), (c12)-(b12), (b12)-(a12) and (a12)-(P1). Under a potential difference (P2)-(P1), all discharges begin conducting a higher current, which is the same in each discharge placed in series with the others.

During the operation of the system described herein as an example, we observe four power gliding discharges installed between five electrodes arranged in line (as suggested by FIG. 12) or in any other geometric structure that makes it possible to arrange the discharges in an electrical series. These discharges are only fed by two cables connected to a high voltage power supply. Considering the sum of distances (d) between all electrodes, this "open circuit" high voltage would not be sufficient to ignite a single discharge between two electrodes separated by a distance of 4·(d). However, this high voltage is sufficient to ignite one discharge after another, in a cascade, and then establish the four power discharges. These discharges evolve according to the hydraulic thrust of the flux (F), the voltage fluctuation between (P2) and (P1) (e.g. in a pulsating or alternating current power supply), and any other phenomenon acting on the individual behavior of each discharge. However, the discharges are no longer independent and each individual discharge influences the others through their connection in series, due to their possible proximity (by radiating one on the other), etc. Finally, we observe a series of four discharges that are highly unstable, highly fluctuating . . . but which sustain each other perfectly by producing four continuous "electrical flames" that are impossible to "extinguish". As soon as any pair of electrodes is no longer connected by a discharge (e.g. at the end of the "natural" path of the discharge over these electrodes)—a new discharge is initiated at the spot where these electrodes are closest (the GlidArc principle), by a pilot discharge through a resistance (R1), (R2) or (R3). The law of electric current continuity also causes the disappearance of the other discharges in line—but, at this specific time, the spaces between the electrodes remain sufficiently ionized to allow for the immediate reignition of the discharges, one after the other.

The resistances (R1), (R2) and (R3) do not use up any energy as they only conduct a very low current during rare ignition moments. As an example, we use resistances of the order of a few MΩ and 1 W that remain warm, even after long hours of operation.

The following innovative contribution should be noted: we observed that, in order to achieve the proper ignition of the four discharges described herein (still as an example), it is preferable that the resistances (R1), (R2) and (R3) show decreasing values (R1)<(R2)<(R3). For example, for a peak-to-peak voltage (P2)-(P1) of the order of 15 kV (50 Hz), and for initial distances of the order of 2 mm (lowest) between diverging steel electrodes, the appropriate resistance values are (R1)~1 MΩ, (R2)~2 MΩ, and (R3)~4 MΩ. This observes some balance between all series resistances during the ignition of the discharges in cascade. In fact, the current flowing through the discharges that are being ignited one after the other increases gradually, which helps to guarantee the ignition of the entire line of discharges.

The other outstanding feature of the invention is the fact that two, three, or even four discharges are arranged in series. We already mentioned solutions to limit the current of a gliding discharge by using a series resistance (see FIG. 1 or 4), but we criticized such solutions because of the dissipation of purely thermal energy in the form of Joule's heat loss outside of the GlidArc device. By using a GlidArc discharge as a resistance for another GlidArc discharge—and vice versa—we dissipate all the energy within the device itself. Moreover, this energy is very active as it dissipates in a gliding electric discharge (with all the properties described above), in the flow of material to be treated. These extremely unstable gliding discharges can be arranged in series, and they sustain each other in a self-regulaulting manner. Surprisingly, these discharges can operate for a time that is determined only by the presence of voltage (P1)-(P2).

The energy efficiency of the power supply thus becomes significantly higher. Its "open circuit" voltage only needs to be sufficient to ignite a single discharge of the system of discharges in series. Then, the current delivered by the power supply must be sufficient to sustain the main discharges in series. This current is already partially self-limited by the resistances of these discharges and, therefore, the power supply only needs to be given a low self-inductance (or an external series inductance) in order to regulate the mean current of all discharges at a level that is compatible with the desired application of the GlidArc. For example, the power factor for a structure with four electrodes (thus, three discharges) supplied by a 50 Hz leak transformer (10 kV open circuit voltage, 1 kVA) is equal to 0.36, while it was approximately 0.14 for a system with two electrodes.

The circuit shown in FIG. 12 is only provided as an example where the four discharges are crossed by four flows (F). Of course, the flow may be arranged so that it crosses the discharges one after the other.

Figure 13:
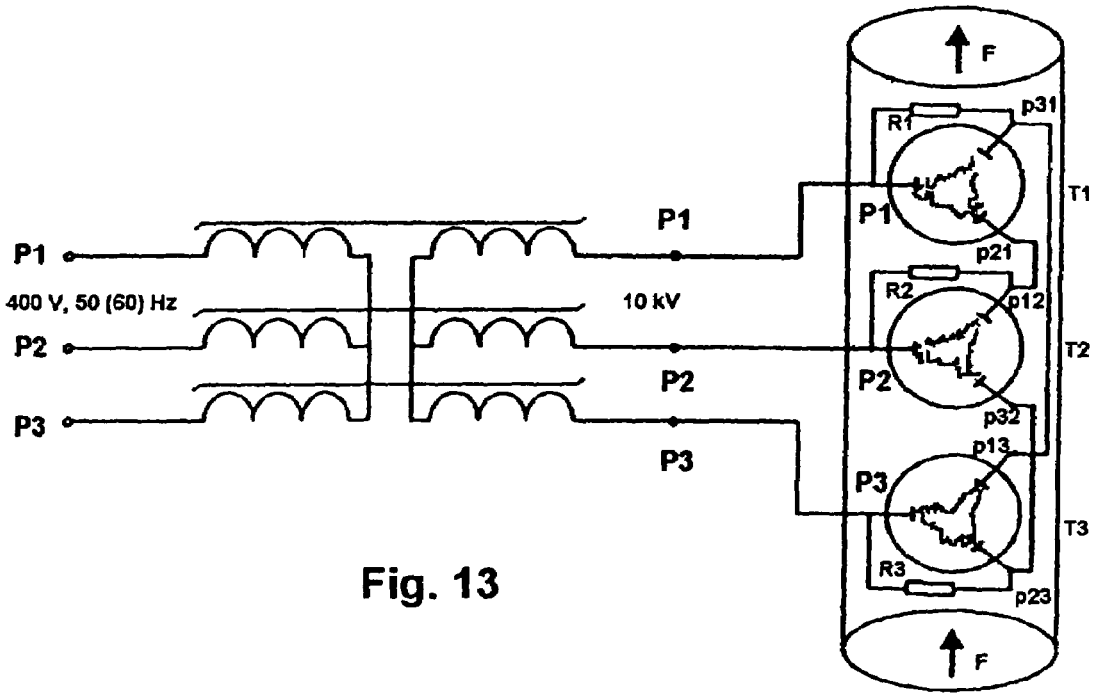
FIG. 13 is a diagram illustrating a device for the simultaneous supply of nine power electrodes connected to a single three-phase transformer.

D. Self-Ignition Circuit Feeding Simultaneously Nine Power Electrodes Connected to a Single Three-Phase Transformer FIG. 13 shows a method of application of the simultaneous supply of nine power electrodes connected to a single three-phase transformer (P1)-(P2)-(P3). According to this innovative circuit, the high-voltage three-phase electric discharges are arranged in series—parallel, in the manner described below:

The current delivered by the phase (P1) coming out of a step-up transformer and connected directly to the electrode (P1) located in a triad (T1) (self-contained structure of three power electrodes) can flow into the phase (P2) by first running through a discharge between this electrode (P1) and the electrode (p21) located in the same triad, and by then running through another discharge between the electrode (p12), which is connected by a cable to the electrode (p21), but located in another triad (T2), and the electrode (P2).

The current delivered by the same phase (P1) connected to the electrode (P1) of the same triad (T1) can still flow into the phase (P3) of the transformer, by first running through another discharge between this electrode (P1) and the electrode (p31) located in the same triad, and then through another discharge between the electrode (p13), under the same potential as the electrode (p31), but located in another triad (T3), and the electrode (P3).

Likewise, the current delivered by the phase (P2) coming out of the transformer and connected directly to the electrode (P2) located in the triad (T2) can flow into the phase (P3), by first running through a discharge between the electrode (P2) and the electrode (p32) located in the same triad, and then through another discharge between the electrode (p23), which is connected by another cable to the electrode (p32), but located in the triad (T3), and the electrode (P3).

The current delivered by the same phase (P2) connected to electrode (P2) of the same triad (T2) can still flow in the phase (P1) of the transformer, by running first through another discharge between this electrode (P2) and the electrode (p12) located in the same triad, and then through another discharge between the electrode (p21), which is on the same potential as electrode (p12), but located in the triad (T1), and the electrode (P1).

Finally, in a similar manner, the current delivered by the phase (P3) coming out of the transformer and connected directly to the electrode (P3) located in the triad (T3) can flow in the phase (P1), by first running through a discharge between the electrode (P3) and the electrode (p13) located in the same triad, and then through another discharge between the electrode (p31), which is connected by another cable to the electrode (p13), but located in the triad (T1), and the electrode (P1).

The current delivered by the same phase (P3) connected to the electrode (P3) of the same triad (T3) can still flow in the phase (P2) of the transformer, by first running through another discharge between this electrode (P3) and the electrode (p23), which is located in the same triad, and then through another discharge between the electrode (p32), which is on the same potential as the electrode (p23), but located in the triad (T2), and the electrode (P2).

Given the nature of GlidArc discharges, it is also necessary to provide for their initial ignition and, then, for their successive reignitions after their extinction. This function is provided by resistances (R1), (R2) and (R3) of high values (in the order of MΩ) connecting electrodes (P1) with (p31), (P2) with (p12), and (P3) with (p23), respectively. These resistances thus provide a galvanic connection of the circuit that would otherwise be broken, which would prevent the establishment of an initial ignition discharge in each of the triads. Let us consider an example:

The electrode (P1) in the triad (T1) in under a high potential delivered by the phase (P1) of the transformer. The electrode (p21) located in the same triad (T1) is connected to phase (P2) by the resistance (R2) and, therefore, (p21) is under the potential (P2) since the current is not yet flowing. The potential difference (P1)-(P2) is sufficient for a low-current (in the order of about ten mA) pilot discharge limited by the resistance (R2) to be established between the electrodes (P1) and (p21) in the triad (T1).

Likewise, the electrode (P2) in the triad (T2) in under a potential (P2). The electrode (p32) located in the same triad (T2) is connected to phase (P3) by the resistance (R3) and, therefore, (p32) is under a potential (P3). The potential difference (P2)-(P3) is sufficient for another low-current pilot discharge limited by the resistance (R3) to be established between the electrodes (P2) and (p32) in the triad (T2).

Furthermore, the electrode (P3) in the triad (T3) is under a potential (P3). The electrode (p13) located in the same triad (T3) is connected to phase (P1) by the resistance (R1) and, therefore, (p13) is under a potential (P1). The potential difference (P3)-(P1) is sufficient for another low-current pilot discharge limited by the resistance (R1) to be established between the electrodes (P3) and (p13) in the triad (T3).

Consequently, we have three initial (pilot) discharges in the three triads: (P1)-(p21), (P2)-(p32), and (P3)-(p13). These discharges are in the area where the electrodes are closest. The discharges, which are blown by the flow (F) running through them, ionize this area, thereby causing the instantaneous establishment of the primary discharges.

Now the electrode (p21) in the triad (T1) is under a potential close to that of (P1), since (p21) is connected to (P1) by the pilot discharge. At this time, the electrode (p12) located in (T2) and connected to (p21) by a conductor cable, receives the same potential, which is well different from that of (P2). Thus, in the area (T2) previously ionized by the adjoining pilot discharge (P2)-(p32) that has just been established, we observe a new discharge between (p12) and (P2). The current of this discharge is only limited by the sum of the series resistances that are specific to the discharges which have now become primary, (P1)-(p21) and (p12)-(P2). These new power discharges significantly increase the ionization of the areas in the triads (T1) and (T2). Likewise, the electrode (p32) in the triad (T2) is under a potential close to that of (P2), as (p32) is now connected to (P2) by the pilot discharge. At this time, the electrode (p23) connected to (p32) receives the same potential, which is well different from that of (P3). Thus, in the area (T3) previously ionized by the adjoining pilot discharge (P3)-(p13), we observe a new discharge between (p23) and (P3). The current of this discharge is only limited by the sum of the series resistances that are specific to the discharges which have now become primary, (P2)-(p32) and (p23)-(P3). These new power discharges significantly increase the ionization of the areas in the triads (T2) and (T3). Likewise, the electrode (p13) in the triad (T3) is under a potential close to that of (P3), as (p13) is now connected to (P3) by the pilot discharge. At this time, the electrode (p31) connected to (p13) receives the same potential, which is well different from that of (P1). Thus, in the area (T1) previously ionized by the adjoining pilot discharge (P1)-(p21), we observe a new discharge between (p31) and (P1). The current of this discharge is only limited by the sum of the series resistances that are specific to the discharges which have now become primary, (P3)-(p13) and (p31)-(P1). These new power discharges significantly increase the ionization of the areas in the triads (T3) and (T1).

Three new discharges are thus ignited, each in the triads (T1), (T2), and (T3), respectively. Let us consider first the triad (T1): The space between the three electrodes (P1), (p21) and (p31) has just be strongly ionized by the discharges between (P1)-(p21), and between (P1)-(p31). The potential of electrode (p21) is related to the potential of electrode (P1) through Ohm's law, which takes into account the resistance and current of this discharge (P1)-(p21), while, at the same time, this potential in (p21) is related to the potential of electrode (P2) through Ohm's law, which takes into account the resistance and current of this discharge (P2)-(p12). The two electrodes (p21) and (p12) are connected by a conductor (cable) and, therefore, they are under the same resulting potential. The potential of the adjoining electrode (p31) in the same triad (T1) results from the resistance and current of the discharge (P1)-(p31), and also from the resistance and current of another discharge (P3)-(p13) in the triad (T3). The two electrodes (p31) and (p13) are connected by a cable and, therefore, they are under the same resulting potential, which is not necessarily the same as the potential of (p21) and (p12). Therefore, due to the potential difference between the electrodes (p21) and (p31) in the same triad (T1), we observe a new discharge between the electrodes (p21) and (p31). The current of this discharge is limited by its own resistance, but also by the resistances of the discharges (P1)-(p21) and (P3)-(p13), which are in series with the discharge in question (p21)-(p31). Therefore, the current of this additional discharge is slightly lower, as it is limited by three discharges in series (instead of two discharges in series), but this new discharge contributes its additional energy to the treated flow (F). Without going into specific details, we also observe two additional discharges, (p12)-(p32) in the triad (T2), and (p13)-p23) in the triad (T3).

Therefore, during the operation of the system described herein, we observe nine gliding power discharges located between nine electrodes that are grouped three by three in three triads. These discharges are supplied by only three cables coming out of a high-voltage three-phase transformer. This "open circuit" high voltage is sufficient to ignite, in the three triads (T1), (T2) and (T3), the three pilot discharges with current limited by the external resistances (R1), (R2) and (R3). These low discharges are sufficient to ionize the space in the triads, which provides for the establishment of the nine power discharges. These discharges evolve according to the hydraulic thrust of the flow (F), the rotation of the phases, the oscillation of the voltage imposed by the supply frequency (e.g. 50 Hz), and any other phenomenon acting on the individual behavior of each discharge. However, the discharges are no longer independent, and each affects the others through their connection in series, due to their proximity (by radiating one on the other, by scattering ions and electrons around them, etc.). In conclusion, we observe a series of nine discharges that are very unstable, highly fluctuating . . . but which sustain each other by producing three continuous "electrical flames" that are impossible to extinguish in the three triads. As soon as any pair of electrodes is no longer connected by a discharge (e.g. at the end of the "natural" path of the discharge over these electrodes)—a new discharge is initiated at the spot where these electrodes are closest (the GlidArc principle), as a result of a pilot discharge through a resistance (R1), (R2) or (R3). A new discharge can also be initiated as a result of the residual ionization of the space between the electrodes, which has just been left in place after the disappearance of the previous discharge . . .

The resistances (R1), (R2) and (R3) do not use up any energy as they only conduct a very low current during rare ignition moments. As an example, we use resistances of approximately 2 MΩ and 1 W that remain warm, even after long hours of operation.

The most significant feature of our invention is the fact that two or even three discharges are arranged in series in a three-phase system. We already mentioned solutions to limit the current of a gliding discharge by using a series resistance (see FIG. 1 or 4), but we criticized such solutions because of the dissipation of purely thermal energy in the form of Joule's heat loss outside of the GlidArc device. By using a GlidArc discharge as a resistance for another GlidArc discharge (and vice versa), we dissipate much more energy within the device itself. Moreover, this energy is very active as it dissipates in a gliding electric discharge (with all the properties described above), in the flow of material to be treated. Our invention also shows that these two (or three) extremely unstable gliding discharges (per triad) can be arranged in series, and they sustain each other in a self-regulating manner. Surprisingly, the nine discharges in a three-phase system can operate for a time that is determined only by the presence of the three-phase voltage at the outlet of the transformer.

The energy efficiency of the transformer thus becomes significantly higher. The "open circuit" voltage of the transformer only needs to be sufficient to ignite a single discharge in each triad. Then, the current delivered by each phase of the transformer (on the high-voltage side) must be sufficient to sustain four main discharges in series—parallel. For example, the current delivered by the phase (P1) feeds the discharges (P1)-(p21) and (p12)-(P2) in series, while it also feeds two other discharges (P1)-(p31) and (p13)-(P3) in series. This current is already self-limited by the resistances of these discharges and, therefore, the transformer only needs to be given a low self-inductance (or other inductances in series on each current line coming out of the transformer) in order to regulate the mean currents of each discharge at a level that is compatible with a specific application of the GlidArc. Our tests have shown that the impedance of the transformer (or of the line feeding the discharges) could thus be reduced by a factor of 2, and that it was not necessary to add external resistances in the circuit, other that the ignition resistances (R1), (R2), and (R3).

The assembly shown in FIG. 13 is only provided as an example where the three triads are arranged in series in relation to the flow F that runs successively through each of them. Of course, the triads may be arranged parallel to three flows (F), with each flow running through a single triad.

E. Multistage Self-Ignition Circuit Supplying Simultaneously Several GlidArc-I Electrodes Connected to a Power Supply This arrangement of the electrodes is shown on FIG. 14, in two versions a) and b), provided as examples. It is used to spread the action of the electric discharges along the same device covered by a flow (F).

It was previously shown that the high turbulence of the flow significantly enhances the quality of its treatment. The turbulence generated by the quick movement of the flow also causes the scattering of ions and electrons in the direction of the flow, thus providing for the ignition of a discharge between distant electrodes in an area covered by these particles. Therefore, by distributing the electrodes between the different stages along the flow, it became possible to obtain a good distribution of the electric discharges in the flow to be treated.

FIG. 14*a* shows a mini-GlidArc-I with two electrodes (p1) and (p2)—however this number is only provided for information purposes since, in this case, it is possible to consider, for example, three electrodes connected to a three-phase power supply—located at the base of a main power supply that also contains two electrodes (P1) and (P2), used as an example. The same voltage supply can feed both GlidArcs. Initially, the voltage (P1)-(P2) is not sufficient to ignite the primary discharge, because the primary electrodes are too distant. However, this voltage is sufficient to ignite the pilot discharge between the auxiliary electrodes (p1) and (p2), which are much closer to each other. The current of this pilot discharge is limited by the series resistances (R1)+(R2), so as to provide only for the sufficient ionization of the flow (F) running near the electrodes (p1) and (p2). It then becomes possible to generate a primary discharge in the partially ionized flow (F) entering the space between the electrodes (P1) and (P2) under an open circuit voltage of the power supply. The current of this discharge is limited only by its own resistance, and since there is enough distance between the electrodes (P1) and (P2), the resistance of the discharge could even be sufficient to automatically limit this current to an optimal value that is compatible with the treatment of the flow.

Of course, we could consider a single- or multiphase, direct, pulsating or alternating current power supply feeding more than two ignition electrodes and/or more than two power electrodes . . . For some geometric configurations, when the electrodes (p1) and/or (p2) are too close to the electrodes (P1) and/or (P2), according to the direction of the flow, we arrange all of these electrodes in a quincunx. Thus we prevent one or several discharges from being established in a lasting manner between the two stages, which would put them in a short-circuit, causing the sudden increase of current in the ignition stage.

FIG. 14*b* shows another version of the principle for which a first version was previously shown on FIG. 14*a*. It consists of a series of GlidArc-I devices with two electrodes in the form of segmental electrodes (however, this number of "two" is only provided for reference purposes since, in this case, it is possible to consider, as an example, three electrodes connected to a three-phase power supply). As before, the first stage—in relation to the direction of the flow (F)—takes place between the ignition electrodes (p01) and (p02). The same voltage supply can feed three GlidArcs. Initially, the voltage (P1)-(P2) is not sufficient to ignite the primary discharge (P1)-(P2) or even the intermediate discharge (p1)-(p2), since the primary and intermediate electrodes are too distant. However, this voltage is sufficient to ignite the pilot discharge between the first auxiliary electrodes (p01) and (p02), which are close to each other. The current of this pilot discharge is limited by the series resistances (R1)+(R01)+(R2)+(R02) so as to provide only for the sufficient ionization of the flow (F) running near the electrodes (p01) and (p02). It then becomes possible to generate an intermediate discharge in the partially ionized flow (F) entering the space between the electrodes (P1) and (P2) under an open circuit voltage of the power supply. The current of this discharge is limited by its own resistance and by the series resistances (R1)+(R2). In turn, the discharge (p1)-(p2) ionizes the space between the primary electrodes, in spite of their great separation. Since there is enough distance between these electrodes (P1) and (P2), the resistance of the discharge could even be sufficient to automatically limit this current to an optimal value that is compatible with the treatment of the flow.

As before, we could consider a single- or multiphase, direct, pulsating or alternating current power supply feeding more than two ignition electrodes and/or more than two intermediate electrodes and/or more than two power electrodes . . . For some geometric configurations, when the ignition and/or auxiliary and/or primary electrodes are too close to each other (according to the direction of the flow), we arrange all (or some) of these electrodes in a quincunx. Thus we prevent one (or several) discharge(s) from being established in a lasting manner between the stages, which would put them in a short-circuit, causing the sudden increase of current in the ignition stages.

Finally, instead of segmenting the electrodes (case of FIG. 14*b*), we cut them in a continuous manner from a material that is not very conducting, such as a metal-ceramic composite. The electrical crosspoint of each electrode (e.g. in the shape of a knife or stick) was placed in the spot where the electrode is the farthest from the other electrode. In such configuration, the resistance of the electrode is minimal near the crosspoint, and maximal towards the point where the electrode is closest to the other electrode. Therefore, such resistive electrode presents the case of FIG. 14*b* with an extremely fine segmentation. Of course, some electrodes located near the resistive electrode may be highly conducting (e.g. metal). As usual, the ignition occurs in the smallest space between the electrodes. The current of such pilot discharge is well limited (to the maximum) by the resistances presented by the electrodes themselves. As before, following the gliding of the discharge as it is being pushed by the flow, the position of the discharge becomes increasingly better in relation to the external resistance in series with the own resistance of the discharge. Then the current of the discharge increases, as well as its length, and the portion of electrical power dissipated in the filament of the discharge also increases. However, the heat dissipated by the Joule effect in such electrode decreases gradually. At the end of the run of the discharge, we observe the optimal conditions that are specific to the GlidArc . . . but that is when the discharge disappears . . . reappearing in a spot near the area where it began its run. Besides, we need to make sure that the discharge disappears, because if it remains attached to the end of the electrodes, it would stop gliding and overheat our electrodes, causing their early destruction.

However, we find it unfortunate that a portion of the electrical energy be dissipated in the form of heat by the Joule effect . . . on the other hand, we are encouraged by the fact that this energy remains in the flow. However, we have already demonstrated that the thermal energy contributed by a gliding discharge could be beneficial in some cases, and detrimental in others. To this effect, it should be mentioned that the GlidArc is always a compromise between the extreme simplicity of a plasma generator and the efficiency of its energy output.

F. Self-Ignition Circuit and Resistive Electrode of Several Mobile Discharges

The last case (E) showing the usefulness of one (or several) resistive electrode(s) could be particularly appropriate for the supply of a GlidArc-II device. FIG. 15*a* shows an example of such innovative assembly consisting of three fixed electrodes (P1), (P2) and (P3) connected to three poles (P1), (P2) and (P3) of a three-phase transformer. The high-voltage outputs of the transformer that supply the three electrodes originate from the "star" assembly of the windings, where the neutral point is typically grounded (T). If the direct grounding (earthing) is not possible for any reason whatsoever, then this neutral point can be grounded indirectly through any resistance (impedance). The central electrode (P0), which is mobile, is generally grounded for safety and technological reasons; in most cases, its rotation is provided by a metal shaft which sometimes contains other mobile electrodes that are also grounded. These electrodes present a metal disk or a metal brush, see BF 98.02940 (2775864), in order to form a multistage reactor. We comply with this choice to "ground" (earth) the rotation shaft and its mechanical drive.

The innovative part consists in using a disk which is made, at least partially, of a resistive material that exhibits a few MΩ (typically 2 MΩ) between the shaft of the disk, which is always grounded (T), and a point located on its circumference. Such disk (e.g. made of a metal-ceramic composite) must also exhibit a resistance in the order of kΩ only (typically 2 kΩ) between two points located on its circumference, and separated by 120° for the case shown in FIG. 15*a* (three electrodes separated by 120°). The mode of operation is as follows:

In the absence of a discharge, the mobile disk (P0) is entirely on the ground potential (T). If the dielectric breakdown distance is short enough in relation to the potential difference between any electrode (P1) or (P2) or (P3) and the disk (P0), then a first discharge is established where the potential difference between a phase—for example (P1)—and the neutral or the ground (T) is the strongest. The current running through this pilot discharge is highly limited by the resistance between the attachment of the discharge at the circumference of the disk and the axis of the disk (a few MΩ). At this moment, we observe that the potential of the disk in its part located near the circumference (thus away from the axis) is getting closer to that of the phase which gives rise to the pilot discharge, (P1) in our example. The differences between this potential and the potentials of the phases that are not yet connected to the disk, (P2) and (P3) in our example, are therefore similar to the open circuit voltages between the high-voltage phases of the transformer (which are higher than the voltages between the phases and their neutral point). Two other discharges, (P2)-(P0) and (P3)-(P0) in our example, are established and become immediately energized since, now, under the voltages between the phases (P1)-(P2), (P2)-(P3) and ((P3)-(P1), the only resistances that are limiting the current are: the resistance of the resistive band located near the circumference of the disk (of the order of one kΩ), the own resistance of the discharge, and the impedance of the transformer. Once that these three discharges are established, we create a space around the disk that is so ionized that these three discharges no longer disappear (visual observation), or are rather easily reignited.

Another mode of operation that provides for the formation of a first pilot discharge is presented in FIG. 15*b*. We simply add a conductive "bump" (B) on the disk (P0) to force the first ignition of a pilot discharge. Of course, additional bumps may be added at regular intervals on the circumference of the disk. For mechanical reasons, we make sure that the height (d−) of this bump is less than the distance (d) between the fixed electrodes (P1), (P2) and (P3) and the electrode (P0); this means that (d)−(d−)>0. The other characteristics of the invention remain the same: three fixed electrodes (P1), (P2) and (P3) connected to the three poles (P1), (P2) and (P3) of the three-phase transformer that are arranged in a "star" pattern, with the neutral point grounded (T), etc.

Just like before, the disk is made of a resistive material. In the absence of a discharge, the mobile disk (P0) is on the ground potential (T). However, this time, the dielectric breakdown distance is periodically brought back to a value controlled by the potential difference between any electrode (P1) or (P2) or (P3) and the bump (B). When this bump rotates in front of any electrode (P1) or (P2) or (P3), a first discharge is established following the reduction of the distance between the disk (P0) and the bump (B). The current running through this pilot discharge is limited by the resistance between its attachment to the disk and the axis of the disk. At this time, the potential of the disk in its part located near the circumference is getting closer to that of the phase which gives rise to the pilot discharge. The differences between this potential and the potentials of the phases that are not yet connected to the disk are therefore similar to the open circuit voltages between the high-voltage phases of the transformer. Two other discharges are established and become immediately energized since, now, under the voltages between the phases, the only resistances that are limiting the current are the resistance of the resistive band located near the circumference of the disk, the own resistance of the discharge, and the impedance of the transformer. Once that these three discharges are established, we create a space around the disk that is so ionized that these three discharges no longer disappear, or are rather easily reignited, preferentially when the bump runs in front of a fixed electrode.

It should be mentioned that the round shape of the bump and its relatively small size (d–), preferably up to 10 mm, provide for the ignition or reignition of the discharges while protecting this shape against thermal erosion. The bump may run quickly in front of a fixed electrode when the primary discharge is well established. This may periodically shorten the discharge (in our example, the frequency of this event was equal to three times the rate of rotation of the disk) and slightly increase its current. However, the current increase is not significant since the current is limited by the resistance of the other discharge, which is always in series, and by the resistance that depends on the nature of the electrode (P0).

Many different embodiments of the invention disclosed herein are possible. Examples of the various alternative embodiments are described briefly below.

One alternative embodiment comprises a device and circuit for the ignition and reignition of an unstable electric discharge between the primary electrodes (1), characterized by the presence of an electrode (2) set in the geometric center of the electrodes (1) of this quasi-periodic discharge, as shown in FIGS. 8 and 9, where the electrode (2) is independently supplied by a circuit (3) and (4) which feeds it high-voltage pulses of several tens of kV in relation to the electrodes (1), thus creating an additional ignition and reignition discharge of said unstable discharge between the electrodes (1), as said ignition and reignition discharge runs between the electrode (2) and any electrode (1), knowing that the ignition and reignition discharge begins successively between each of the primary electrodes (1) and the ignition and reignition electrode (2), thus forming between the electrodes (1) and the electrode (2) a current path for the main supply circuit of the unstable discharge between the electrodes (1), and knowing that the repetition rate of the ignition discharge is such that said discharge appears in the form of individual sparks, with a cycle time between two sparks that is less than the duration of an ignition and extinction cycle of the unstable discharge that develops between the primary electrodes (1), which are brought to relative voltages of the order of a few kV and separated so as to prevent the ignition of the primary discharge in the absence of electrode (2) and its active ignition circuit (3) and (4).

Another alternative embodiment comprises an ignition and reignition electrode (2) characterized by its shape, as shown in FIG. 9*b*, which resembles the frame of a partially open umbrella or otherwise as a star (top view), with each branch extending towards one of the primary electrodes (1), which makes it possible to selectively and automatically start a pilot discharge between the electrode (2) and one of the primary electrodes (1) that is not subject to a discharge, following which these two electrodes are immedialty short-circuited by a spark, after which the electrode (2) acts as a short-circuit bridge between the electrodes (1), so that the discharges, which are now primary discharges, may glide in a flow over the electrode (2) until they meet at the top of the electrode (2), due to its divergent shape (side view), and then these primary discharges will spread freely between the electrodes (1) until their extinction, knowing also that the electrode (2) is shaped to match the flow that goes around it, so that this flow may run between the branches of the star and enable the ignition discharges to glide over the electrode (2) without diverting the flow or overheating the electrode (2), which shall preferably be made of a conductive refractory material or a metal with a high melting point.

Another alternative embodiment comprises a self-contained device for the ignition, reignition and supply of an unstable electric discharge between two electrodes, based on a transformer such as the one shown in FIG. 10, consisting of two low-voltage primary power windings ($P_1$) and ($P_2$) with pulses of adjustable amplitude and phase, and a single high-voltage secondary winding (S); device characterized by the fact that the effects produced by each primary winding are superimposed onto the secondary winding (S) of the transformer, knowing that this transformer shows a magnetic induction at the core that is approximately 30% higher than usual, and that a pulse source supplies its winding ($P_2$) with high current peaks that correspond to ignition pulses of which the amplitude is at least equal to the peak value of the sinusoidal signal fed to the winding ($P_1$), with a duration limited to less than 1 ms; the device is also characterized by the fact that the moment of ignition of the primary discharge is very close to the moment that the sinusoidal power voltage goes through zero.

Another alternative embodiment comprises a controlled cascade self-ignition and reignition circuit, as shown in FIG. 12, feeding simultaneously three or more electrodes connected to a single power supply, and characterized by the fact that several high-voltage discharges are ignited sequentially by the propagation of pilot discharges of the order of tens of mA, which are ignited due to the resistances of the order of MΩ that connect the electrodes, thus providing a galvanic connection of the circuit that would otherwise be broken, after which the unstable power discharges are immediately established in series and reignited after a current cutoff; the circuit is also characterized by resistances of such value that the resistance short-circuited by a previous pilot discharge is higher than the resistance which will take over the following pilot discharge, in order to ensure that the value of the current increases gradually for each pilot discharge, according to the development of pilot discharges in series.

Another alternative embodiment comprises a circuit for the self-ignition, reignition and simultaneous supply of high-voltage unstable discharges between nine power electrodes connected to a single three-phase transformer, characterized by the fact that nine discharges in series—parallel are arranged in the manner described in FIG. 13, making it possible to ignite these discharges through the propagation of pilot discharges which are ignited due to resistances of the order of MΩ, arranged as indicated in FIG. 13, and connecting the electrodes so as to provide a galvanic connection of each branch of the three-phase circuit which would otherwise be broken, after which the nine unstable power discharges are established in series and in parallel and/or automatically reignited after any current cutoff in any branch of the circuit.

Another alternative embodiment comprises a multistage circuit, as shown in FIG. 14*a*, for the self-ignition and successive reignition of a high-voltage unstable discharge between two pairs of electrodes that are connected to a single power supply, characterized by the fact that a pilot discharge is ignited between two ignition electrodes which are brought close to each other so as to provide for the ignition of the pilot discharge under the voltage supplied by the power supply, where the current of the pilot discharge is limited by one or two resistances in series with the power supply, and this same pilot discharge is carried by a flow of diluted material towards the other pair of power electrodes being supplied simultaneously by the same power supply, without making galvanic contact with these power electrodes, which is achieved by arranging two successive stages of electrodes in a quincunx, as the pilot discharge causes a partial ionization between these power electrodes, which are much more separated than the ignition electrodes; this ionization is caused by the ions and electrons generated in the pilot discharge and scattered in the direction of the flow, thereby making it possible to ignite and sustain a primary power discharge between these power electrodes in an area covered by these ionizing particles, until it becomes extinguished following its movement to the end of the power electrodes.

Another alternative embodiment comprises a multistage circuit, as shown in FIG. 14*b*, for the self-ignition and successive reignition of a high-voltage unstable discharge between several pairs of electrodes that are connected to a single power supply, characterized by the fact that a pilot discharge is ignited first between the two ignition electrodes that are closest to each other so as to provide for the ignition of this pilot discharge under the voltage supplied by the power supply, where the current of the pilot discharge is limited by several resistances in series with the power supply, and this same pilot discharge is then carried by a flow of diluted material towards another pair of adjoining electrodes that have a greater separation between them and are supplied by the same power supply through resistances in series of which the values are less than those of the resistances arranged in series for the previous discharge, and without making galvanic contact with these adjoining electrodes, which is achieved by arranging stages of adjoining electrodes in a quincunx, as the discharge causes a partial ionization between these adjoining electrodes, which is caused by the ions and electrons generated in the previous discharge and scattered in the direction of the flow, thereby making it possible to ignite another discharge that is more powerful than the previous discharge, as the movement of increasingly powerful discharges continues in the same manner, in the direction of the flow, until a final discharge appears between the two power electrodes that have the greatest separation between them and are connected to the same power supply, and then becomes extinguished following its movement to the end of the power electrodes.

Another alternative embodiment comprises a circuit with infinitely fine and continuous segmentation, similar to the circuit shown in FIG. 14*b*, for the self-ignition and reignition of a high-voltage unstable discharge between two electrodes connected to a single power supply, characterized by the fact that at least one of the two electrodes is cut from an electrically resistive material such as a metal-ceramic composite, and that the electrical crosspoint of such electrode shaped like a knife or stick is placed in the spot where this electrode is the farthest from the other electrode of the circuit, in order to create a continuous resistance in series with the power supply, which resistance is minimal near the crosspoint, and maximal near the point where the electrode is closest to the other electrode of the circuit, thereby resulting in the ignition of a pilot discharge in the smallest space between the electrodes, where the current is limited by the maximum resistance of the circuit provided by the electrode itself, knowing that, following the gliding of the discharge over the diverging electrodes as it is being pushed by the flow, the position of the discharge becomes increasingly strong as the external resistance in series decreases, while the actual resistance of the discharge increases, and knowing that the current resulting from the discharge increases, as well as its length and the electric energy dissipated in the discharge, while the heat dissipated in the electrode by the Joule effect decreases gradually until the discharge, which has now become powerful, is extinguished following its movement to the end of the electrodes, which have such separation between them that the voltage supplied to the discharge is not sufficient to sustain said discharge, after which a new discharge is generated between the electrodes.

Another alternative embodiment comprises a circuit characterized by the fact that the power supply consists of several poles of different potentials, such as in a multiphase generator, and that, consequently, several high-voltage unstable discharges are generated between several electrodes; each discharge follows a cycle where it is ignited and then develops until it becomes powerful and is extinguished upon gliding to the end of the electrodes, which have such separation between them that the voltage supplied to the discharge is not sufficient to sustain said discharge, after which a new discharge is generated between these multiple electrodes.

Another alternative embodiment comprises a circuit and electrode (P0), as shown in FIG. 15*b*, for the self-ignition and reignition of three high-voltage unstable electric discharges in a device where this electrode (P0) has the shape of a disk that rotates in relation to three fixed electrodes, which are set at more or less equal distances (d) and are connected to three phases of a high-voltage transformer, characterized by the fact that the rotating electrode consists of a material which presents a few MΩ of resistance between the axis of the electrode and a point located on its circumference, and also presenting a resistance in the order of kΩ between any two points located on its circumference and separated by 120°, which makes it possible to establish a first pilot discharge between a phase and this electrode (P0) upon the passage of a small conductive bump (B) located on the circumference of the electrode (P0), as the current running through the discharge is limited by the resistance between the attachment of the discharge to the electrode (P0) and its axis, where the bump has a height (d−), which should preferably be up to 10 mm, and such that (d−)<(d), knowing that this first pilot discharge could not be formed between any phase of the transformer and the electrode (P0) without the bump, for the voltages delivered by the transformer; the circuit is also characterized by the fact that, after the establishment of the pilot discharge, the other two electrodes are immediately connected between them and with the electrode (P0), which also causes a strong increase of current in the previous pilot discharge, as well as in two other discharges, knowing that these currents are now limited by the resistances of the resistive band near the circumference of the disk, by the resistance of the discharge itself, and by the impedance of the transformer, and, therefore, the three power discharges are established, thereby creating a space around the disk that is so ionized that these three discharges no longer disappear, or are rather easily reignited, preferentially when the bump runs in front of a fixed electrode.

Another alternative embodiment comprises a device characterized by the fact that the ignition and reignition circuit (3) and (4) of an unstable electric discharge between the primary electrodes (1) is independent from the main power circuit that feeds this unstable discharge between the primary electrodes.

This independence is achieved through a capacitance (Cs) equal to or less than 2 nF, which separates the ignition circuit from the main power circuit, thus preventing the electric current of the power supply of the primary discharge, once established, from going through the pulse transformer that constitutes the other integral part of said ignition and reignition circuit, which results in the fact that the ignition and reignition discharge appears in the form of individual sparks, with a separation time between two individual sparks that is much less than the duration of a cycle (ignition-extinction-reignition) of the primary discharge, in order to minimize the idle time between two primary discharges, which time between two individual ignition and reignition RLC oscillating circuit (3) and (4), so that the quality factor Q of said oscillating circuit is approximately 0.5, in order to allow for the quickest possible transmission of the electromagnetic energy of the ignition and reignition circuit into the discharge.

Another alternative embodiment comprises a device characterized by the fact that several primary electrodes (1) of this primary discharge are arranged symmetrically around the intake nozzle of the flow in which this discharge is generated, so that the face-to-face distances between the primary electrodes are approximately equal to the diameter of the nozzle, which may reach several centimeters, which would therefore increase the ignition voltage of the discharge to such a level that, without the additional ignition and reignition electrode (2) located in the geometric center between the electrodes (1), this voltage being generated by the ignition and reignition circuit (3) and (4) and superimposed on the voltage of only a few kV between the electrodes (1), the primary discharge cannot self-ignite; however, the sparks provided by the electrode (2) which is supplied by the circuit (3) and (4) can ignite said discharge in the field that rotates successively between each of the primary electrodes (1) and the ignition and reignition electrode 92), thus covering the entire ignition area, in spite of minor differences in the distances between the electrodes, knowing also that these ignition and reignition discharges are very short, typically lasting tens of us, and that they form between the electrodes (1) a conducting zone for the ionized gas, which creates a current path for the main circuit and thus ignites the primary unstable discharge; the ignition occurs in an automatic and selective manner, so that the electrode (1) without discharge and, therefore, under a higher electric potential that the other electrodes (1), is the first to be short-circuited by an ignition and reignition spark.

What is claimed is:

1. A gas flow chamber device comprising:

a simultaneous arrangement of a plurality of primary power electrodes in the form of triads connected in a series to a single multi-phase transformer;

a secondary high-voltage electrode positioned in a geometric center between each triad of primary power electrodes wherein the distance between the secondary electrode and each of the triad electrodes is shorter than a distance between the primary electrodes in each of the triads;

a first circuit supplying power sequentially to the triads of primary electrodes without causing a discharge between said primary electrodes; and a second circuit supplying high voltage pulses forming an unstable discharge column gliding between the secondary electrode and alternate ones of the triad primary electrodes;

the electrodes being enclosed in a gas-filled chamber wherein the gas is provided with a suitable flow rate.

2. The device of claim 1, wherein the first circuit is independent of the second circuit.

3. The device of claim 1, wherein the primary electrodes of each triad are symmetrically arranged about a central axis.

4. The device of claim 1, wherein the time between each in a rapid sequence of pulses is less than the duration of a discharge between a pair of primary electrodes.

5. The device of claim 1, wherein the duration of each pulse is sufficient to produce a single spark per pulse.

6. The device of claim 1, wherein a voltage applied by the second circuit between the secondary electrode and the primary electrodes is at least about 10 times greater than a voltage applied by the first circuit between the primary electrodes.

7. The device of claim 1, wherein the primary low power supply comprises a high frequency of about 150 kHz.

8. The device of claim 1, wherein the discharges form a conductive zone for an ionized gas between electrodes.

9. The device of claim 1, wherein an electrical current flows discharges from the initial triad to a final triad.

10. The device of claim 1, wherein the triads comprise an external resistance component limiting the current so as to provide reignition of the gliding discharges immediately upon extinction.

11. The device of claim 1, wherein the discharges comprise behavior dependant on hydraulic thrust of the gas flow, the rotation of the phases and the oscillation of the voltage imposed by the power supply frequency.

12. The device of claim 1, wherein the unstable fluctuating gliding discharges sustain each other by maintaining a continuous "electrical flame" in each triad.

13. The device of claim 1, wherein the single high-voltage power supply serves simultaneously all gliding discharges within the triad primary electrodes.

14. The device of claim 1, wherein all the high-voltage discharges are established in a series, the current entering at a first pole and exiting at a second pole flowing through a series of discharges which are initialed or reignited at any positions where the electrodes are proximal.

15. The device of claim 1, wherein at least one of the electrodes involved in causing self-ignition and reignition comprises an electrically resistive material, selected from a metal-ceramic composite.

16. A device comprising:

a plurality of primary electrodes which are symmetric about a central axis, each electrode having a first end and a second end with the distance between the first ends of any two of said electrodes being less than the distance between the corresponding second ends of said two electrodes;

a first circuit for supplying power to the plurality of primary electrodes;

a secondary electrode positioned centrally between the plurality of primary electrodes; and a second circuit for supplying power between the secondary electrode and alternate ones of the primary electrodes.

17. A device comprising:

a plurality of primary electrodes comprising which are symmetric about a central axis, each primary electrode having a first end and second end;

a first circuit for supplying power to the plurality of primary electrodes;

a secondary electrode positioned centrally between the plurality of primary electrodes, the secondary electrode having a first end and a second end, and wherein the secondary electrode is in electrical communication with only one end of each primary electrode; and a second circuit for supplying power between the secondary electrode and alternate ones of the primary electrodes.

18. A device comprising:

a plurality of primary electrodes symmetric about a central axis, wherein a portion of each primary electrode is in direct electrical communication with a portion of every other electrode;

a first circuit for supplying power to the plurality of primary electrodes;

a secondary electrode positioned centrally between the plurality of primary electrodes; and a second circuit for supplying power between the secondary electrode and alternate ones of the primary electrodes.

* * * * *